US007198325B2

(12) United States Patent
Dewert

(10) Patent No.: US 7,198,325 B2
(45) Date of Patent: Apr. 3, 2007

(54) ADJUSTABLE PIECE OF SEATING FURNITURE

(75) Inventor: Eckhart Dewert, Zürich (CH)

(73) Assignee: Deon AG, Zürich (CH)

( * ) Notice: Subject to any disclaimer, the term of this patent is extended or adjusted under 35 U.S.C. 154(b) by 60 days.

(21) Appl. No.: 11/170,091

(22) Filed: Jun. 30, 2005

(65) Prior Publication Data

US 2006/0000022 A1 Jan. 5, 2006

Related U.S. Application Data

(63) Continuation of application No. PCT/EP04/00244, filed on Jan. 15, 2004.

(30) Foreign Application Priority Data

Jan. 15, 2003 (DE) ..... 103 01 326

(51) Int. Cl.
*A47C 17/12* (2006.01)

(52) U.S. Cl. ..... 297/116; 297/117; 5/12.1; 5/52

(58) Field of Classification Search ..... 297/116, 297/117, 118; 5/12.1, 52
See application file for complete search history.

(56) References Cited

U.S. PATENT DOCUMENTS 1,336,062 A * 4/1920 Arton ..... 5/52
1,720,842 A * 7/1929 Keinath ..... 297/116
1,741,048 A * 12/1929 Berry ..... 297/117
2,217,426 A * 10/1940 Zareko ..... 297/117
2,531,045 A * 11/1950 Hoffman ..... 297/117
2,621,708 A * 12/1952 Luce, Jr. ..... 297/117
2,790,482 A 4/1957 Franklin
3,051,965 A 9/1962 Szemplak et al.
3,300,794 A 1/1967 Altorfer
3,447,170 A 6/1969 Spitz (Continued)

FOREIGN PATENT DOCUMENTS

CH 607 682 10/1978

(Continued)

OTHER PUBLICATIONS

Catalogue of the German firm Dewert Antriebs-und systemtechnik "Gesamtprogramm 1995/96" pp. 12 & 13.

(Continued)

*Primary Examiner*—Peter R. Brown
(74) *Attorney, Agent, or Firm*—Shlesinger, Arkwright & Garvey LLP

(57) ABSTRACT

Piece of seating furniture, such as an armchair, includes a basic body on which a seating area is provided. Armrests, such as left and right armrests, are disposed laterally of the seating area. The armrests may be adjusted from a seating position into a lying position in which surfaces of one or more of the armrests form a lying area or a portion of a lying area. In that manner, the piece of furniture may be used for lying down on when the armrests are in there respective lying positions. One or more of the armrests may be pivotably attached to the seating furniture so that the armrests may individually or collectively be adjusted to various positions, so as to provide a variety of seating and lying options for a user of the chair.

30 Claims, 20 Drawing Sheets

U.S. PATENT DOCUMENTS

| | | | | |
|---|---|---|---|---|
| 3,717,376 | A | | 2/1973 | Lutchansky |
| 3,868,103 | A | | 2/1975 | Pageot et al. |
| 4,258,445 | A | | 3/1981 | Zur |
| 4,336,621 | A | | 6/1982 | Schwartz |
| 4,349,924 | A | | 9/1982 | Zur |
| 4,381,571 | A | | 5/1983 | Elliott |
| 4,463,463 | A | | 8/1984 | Kaneko |
| 4,559,656 | A | | 12/1985 | Foster |
| 4,589,151 | A | | 5/1986 | Behrens |
| 4,800,599 | A | | 1/1989 | Korchinski et al. |
| 4,928,332 | A | | 5/1990 | Ogden et al. |
| 5,063,623 | A | | 11/1991 | Bathrick et al. |
| 5,317,769 | A | | 6/1994 | Weismiller et al. |
| 5,329,654 | A | * | 7/1994 | Sherman ..... 5/14 |
| 5,490,298 | A | | 2/1996 | Goldsmith et al. |
| 5,491,854 | A | | 2/1996 | Music |
| 5,537,701 | A | | 7/1996 | Elliott |
| 5,542,744 | A | | 8/1996 | Bathrick |
| 5,544,376 | A | | 8/1996 | Fromson |
| 5,577,280 | A | | 11/1996 | Elliott |
| 5,640,730 | A | | 6/1997 | Godette |
| 5,675,849 | A | | 10/1997 | Koch |
| 5,687,437 | A | | 11/1997 | Goldsmith |
| 5,740,568 | A | | 4/1998 | Elliott |
| 5,870,784 | A | | 2/1999 | Elliott |
| 5,916,086 | A | | 6/1999 | Rossdeutscher |
| 5,926,872 | A | | 7/1999 | Rossdeutscher |
| 5,926,877 | A | | 7/1999 | Lin |
| 6,006,379 | A | | 12/1999 | Hensley |
| 6,061,852 | A | | 5/2000 | Bathrick et al. |
| 6,079,065 | A | | 6/2000 | Luff et al. |
| 6,088,853 | A | | 7/2000 | Jansen et al. |
| 6,101,647 | A | | 8/2000 | Stroud et al. |
| 6,105,187 | A | | 8/2000 | Gnjatovic |
| 6,209,157 | B1 | | 4/2001 | Hensley |
| 6,269,707 | B1 | | 8/2001 | Koch |
| 6,311,348 | B1 | | 11/2001 | Luff |
| 6,393,641 | B1 | | 5/2002 | Hensley |
| 6,679,555 | B2 | | 1/2004 | Bangert |
| 6,687,932 | B1 | | 2/2004 | Bangert et al. |
| 2001/0000828 | A1 | | 5/2001 | Hensley |
| 2002/0152552 | A1 | | 10/2002 | Dewert |
| 2002/0162170 | A1 | | 11/2002 | Dewert |
| 2003/0052238 | A1 | | 3/2003 | Schneider |
| 2003/0079290 | A1 | | 5/2003 | Dewert |
| 2003/0106154 | A1 | | 6/2003 | Takeuchi |
| 2003/0208845 | A1 | | 11/2003 | Heaton |
| 2004/0034934 | A1 | | 2/2004 | Weinman et al. |

FOREIGN PATENT DOCUMENTS

| | | | |
|---|---|---|---|
| DE | 26 14 105 | A | 4/1976 |
| DE | 31 03922 | A1 | 8/1982 |
| DE | 32 182 78 | A1 | 11/1983 |
| DE | 87 11 567 | U1 | 3/1988 |
| DE | 88 00 360 | U1 | 7/1988 |
| DE | 88 06 094.2 | | 7/1988 |
| DE | 38 42 978 | A1 | 7/1989 |
| DE | 91 10 121 | U | 8/1991 |
| DE | 38 42 078 | C2 | 7/1992 |
| DE | 93 11 520 | U1 | 6/1994 |
| DE | 195 00 185 | A1 | 7/1996 |
| DE | 195 03 650 | A1 | 8/1996 |
| DE | 195 42 321 | A1 | 5/1997 |
| DE | 297 01 084 | | 7/1997 |
| DE | 298 00 197 | U1 | 1/1998 |
| DE | 197 39 453 | A1 | 3/1999 |
| DE | 695 07 158 | T2 | 9/1999 |
| DE | 100 17 978 | C2 | 4/2000 |
| DE | 100 17 979 | A1 | 4/2000 |
| DE | 299 19 238 | U1 | 4/2000 |
| DE | 200 00 700 | U1 | 5/2000 |
| DE | 299 07 850 | U1 | 5/2000 |
| DE | 100 46 750 | C1 | 9/2000 |
| DE | 201 00 733 | U1 | 4/2001 |
| DE | 100 46 752 | | 3/2002 |
| EP | 0 373 912 | | 6/1990 |
| EP | 0 372 032 | B1 | 5/1992 |
| EP | 0 583 660 | A1 | 2/1994 |
| EP | 0 721 754 | | 7/1996 |
| EP | 0 873 709 | A1 | 10/1998 |
| EP | 0 884 011 | A1 | 12/1998 |
| EP | 0 935 937 | A1 | 8/1999 |
| FR | 761 361 | A | 9/1933 |
| FR | 2 780 256 | A1 | 12/1999 |
| GB | 2 081 083 | A | 7/1981 |
| IT | 0 568 957 | | 11/1993 |
| WO | 91/01099 | | 2/1991 |
| WO | 92/09520 | | 6/1992 |
| WO | 96/29970 | | 10/1996 |
| WO | 99/42021 | | 8/1999 |

OTHER PUBLICATIONS

Catalogue of the German firm Dewert Antriebs-und Systemtechnik "Antriebe, Handschalter, Steuerungen, Beschläge", No. 05/97 (excerpt 6 pages).

International Search Report dated Nov. 11, 2003 in International Application No. PCT/EP03/06548 filed Jun. 20, 2003.

International Search Report dated Jun. 06, 2001 in International Application No. PCT/EP00/13074 filed Dec. 21, 2000 (3 pages).

PCT Schriftlicher Bescheid (Regel 66 PCT) Nov. 11, 2001.

International Search Report dated Jun. 06, 2004 in International Application No. PCT/EP2004/000244 filed Jan. 15, 2004 (2 pages).

* cited by examiner

ADJUSTABLE PIECE OF SEATING FURNITURE

CROSS-REFERENCE TO RELATED APPLICATIONS

This application is a continuation of application no. PCT/EP2004/000244, filed Jan. 15, 2004, which claims the priority of German application no. 103 01 326.1, filed Jan. 15, 2003, and each of which are incorporated herein by reference.

The invention relates to seating furniture, in particular an easy chair, the type of which is described in the preamble of Claim 1.

Seating furniture of this type is commonly known and features both base bodies, on which the sitting surface is formed, and armrests placed at the sides of the sitting surface.

Chairs with bases featuring adjustable parts are already known. For example, there are chairs in which the backrest can be adjusted from an upright position, where the backrest is substantially vertical, into a reclined position, where the backrest is leaned back. In this context chairs are also known in which the adjustment of the backrest from the upright position to the reclined position results in the tilting of a portion of the base inclined relative to the sitting surface and extending downward when the chair is in its upright position, thereby providing calf support for the person sitting in the chair.

Furthermore, chairs are also known, for example desk chairs, in which the height of the armrests can be adjusted.

DE 299 19 238 U 1 describes a chair of this type, which features a base, on which the sitting surface is formed, and armrests placed at the sides of the sitting surface. The armrests can be adjusted from an upright to a reclined position, wherein the surfaces of the armrests form a portion of the lying surface in such a manner that a bed is formed in the reclined position. Each armrest can be pivoted about a first pivot axis relative to the base.

Similar chairs are also described in DE 298 00 197 U 1 and DE 201 00 733 U 1.

An object of the invention is to provide a chair of the type described in the preamble of Claim 1, wherein the kinematics of the adjustment of the armrest are achieved in a favorable manner and the chair can be manufactured in a simple and cost-effective manner.

This object is achieved in accordance with the teachings of Claim 1.

In accordance with the invention, the pivotable armrest is connected to an electromechanical/electromotive pivot drive and the armrest is mounted on the base perpendicularly displaceable relative to the first pivot axis. In this way, particularly favorable kinematics are achieved for adjusting the respective armrests between upright and reclined positions. It is therefore possible with the inventive kinematics to create from an easy chair of generally cubical design a lying surface of about 2 m in length by setting the armrests in reclined position. This set-up allows tall people to comfortably lie on the thereby formed bed.

A further advantage of the inventive chair can be found in the fact that, thanks to the inventive kinematics, the armrests and thereby the lying surface formed by a portion of the armrest when in a reclined position are adequately disposed relative to the sitting surface in all adjustment settings, without large gaps forming between the armrests and the sitting surface, that could detract from the comfort and overall aesthetics of the piece of furniture.

Owing to its electromechanically driven adjustment system, the inventive chair can be converted from a chair to a bed quickly and easily, while offering the user a high level of comfort.

To facilitate the pivoting of the armrests, a further embodiment of the invention features an armrest connected pivotably about a second pivot axis to a lever mounted on the base, wherein the end of the lever facing away from the second pivot axis is connected pivotably about a third pivot axis to the armrest and the lever is actuated by the pivot drive. This feature results in a simple and robust construction.

To achieve the desired kinematics with a simple and thereby cost-effective construction, it is advantageous if in the embodiment described above the armrest is mounted on the base displaceably along an imaginary line running from the first pivot axis to the third pivot axis.

In principle the sitting surface of the inventive chair can be securely attached to the base. In an especially advantageous embodiment of the invention, the sitting surface includes at least one seat portion mounted to the base, wherein it pivots about a fourth pivot axis relative to the base. In this way, the pitch of the seat portion can be adjusted, thereby significantly expanding the adjustment possibilities of the inventive chair.

To facilitate the comfortable and exertion-free adjustment of the chair, it is advantageous if an electromechanical pivot drive is associated with at least one seat portion.

In principle the adjustment of at least one seat portion can be facilitated by way of an electromechanical adjustment drive provided for adjusting at least one of the armrests. In an advantageous embodiment of the invention having the pivotable seat portion at least two seat portions are present and at least one of the seat portions is connected to a separate pivot drive. In this embodiment at least one of the seat portions can be adjusted independently of armrest adjustment. As a result, the adjustment possibilities of the chair are thereby expanded.

To further expand the adjustment possibilities of the chair, in an advantageous embodiment each of the seat portions is associated with a separate pivot drive. In this embodiment the seat portions can be adjusted independently of one another.

In an especially advantageous configuration of the embodiment with the pivotable seat portion, the fourth pivot axis is substantially perpendicular to the imaginary line spanning the distance between the armrests. In this embodiment the fourth pivot axis is therefore substantially perpendicular to the backrest of the chairs, so that the seat portion and thereby the sitting surface can be tilted toward at least one of the armrests. As a result of this feature, the inventive chair has a wider array of adjustment possibilities, especially in regard to its use as a bed, than that of conventional easy chairs in which the sitting surface can only be tilted away from or toward the backrest.

The pivot drive for at least one of the armrests can be selected according to preference. To achieve an especially simple and cost-effective, as well as robust construction of the pivot drive, an embodiment features a pivot drive with a linear drive, the drive mechanism of which actuates the lever.

In an embodiment of the above described embodiment, the drive mechanism is a spindle nut, which is connected to a rotary driven threaded spindle and moves axially thereto, wherein the spindle nut is secured against rotation, the spindle nut is connected pivotably about a third pivot axis to the lever, and the threaded spindle is connected pivotably about a sixth pivot axis to the base.

If the kinematics of the embodiment described above are reversed, the drive mechanism can also be a threaded spindle, which is secured against rotation and moves axially and to which a rotary-driven spindle nut is connected, wherein the threaded spindle is connected pivotably about a fifth pivot axis to the lever while the spindle nut is connected pivotably about a sixth axis to the base.

To achieve the kinematics of the adjustment of the armrests or at least one of the armrests and/or of the seat portion or at least one of the seat portions in an especially simple manner, the second pivot axis and/or the third pivot axis and/or the fourth pivot axis and/or the fifth pivot axis and/or the sixth pivot axis is/are essentially parallel to the first pivot axis in an advantageous embodiment.

To further simplify the construction, it is advantageous if among the first pivot axis, the second pivot axis, the third pivot axis, the fourth pivot axis, the fifth pivot axis, and the sixth pivot axis, at least two of the pivot axes are parallel to one another.

In another advantageous embodiment of the invention at least one of the pivot axes includes a substantially horizontal pivot axis.

In principle it is possible that the lying surface can be formed exclusively by the armrests set in reclined position. In an advantageous embodiment of the invention, the armrests, when set in reclined position, form together with the sitting surface a lying surface. In this embodiment, the lying surface is extended lengthwise, thereby increasing user comfort.

In principle it is sufficient if the armrests assume either the upright position or the reclined position. To expand the adjustment possibilities and to further increase user comfort, it is however advantageous if the armrests can be directly adjusted between upright and reclined position. This embodiment enables the user to adjust the armrests into any desired position between the upright and reclined positions.

In principle, when in reclined position the lying surface can exhibit, at least in certain sections, a concave and or/convex cross section. In a further embodiment of the invention, however, the lying surface constitutes a substantially level surface when the armrests are in reclined position. In this embodiment, the reclined position results in a substantially level support surface, which is found in beds for example.

Wide latitude is allowed in determining the shape, size and construction of the armrests. To achieve a simple, as well as a stable construction, the armrests are block-like in an advantageous embodiment of the invention. In this embodiment, the armrests can, for example, feature a frame-like base on which the upholstery is mounted.

In another embodiment of the invention, the surfaces of the armrests forming the lying surface or portion thereof when the armrests are in reclined position, are cushioned or softened by a suspension means to further increase comfort. Because of the cushioning or suspension, the user is able to experience significantly greater comfort when lying down.

In the embodiment described above, the type of suspension means employed can be selected according to preference. In an advantageous embodiment, the suspension means comprises a plurality of suspension elements, in particular leaf springs/elastic slats. In this embodiment, an even suspension along the entire lying surface is achieved in a simple and cost-effective manner.

In a particularly advantageous configuration of the embodiment featuring the suspension means, a type of slatted frame serves as the suspension means. This embodiment results in an especially high level of comfort for the user when the armrests are in reclined position, as is commonly seen in beds with slatted frames.

In an especially advantageous embodiment of the invention, at least one of the armrests features a support on its end facing away from the sitting surface, which can be adjusted relative to the armrest. In this embodiment the adjustment possibilities, and thereby user comfort, are increased. In particular, an armrest set in reclined position and supporting the upper body of the user can feature an additional support for providing head and/or back support to the user when he or she is lying down. In this way, a separate neck support is formed, as is found in adjustable slatted frames. Furthermore, one of the armrests set in reclined position and supporting the user's legs can feature an additional support, which, for example, can provide calf support, as is commonly found in slatted frames. If both armrests are equipped with an additional support and the sitting surface forms a portion of the lying surface when set in reclined position, the result is a five-part construction commonly found in slatted frames, in which the sitting surface forms a middle support, while one of the armrests forms an upper body support with the support projecting therefrom providing head support and the other armrest forming leg support with the support projecting therefrom providing calf support. In this manner a wide array of adjustment possibilities with high comfort are provided, as is commonly found in adjustable slatted frames featured in beds.

The additional supports projecting from the armrests can be adjusted relative to the armrests. To achieve simple kinematics and thereby simple construction, it is advantageous if the support can be pivoted about a pivot axis relative to the armrest from which it projects.

If both armrests are adjustable, the setting of the armrests can be adjusted by a common adjustment mechanism. To expand the adjustment possibilities, it is advantageous if each of the armrests is connected to a separate adjustment mechanism to facilitate the adjustment of the respective armrest between its upright and reclined positions, as is found in an advantageous embodiment.

The invention teaches that the adjustment mechanisms can be activated in a coordinated fashion. The adjustment possibilities can also be expanded if the adjustment mechanisms connected to the armrests can be activated independently of one another, as is found in an advantageous embodiment of the invention.

It is advantageous if the surfaces of the armrests facing one another in upright position form the lying surface or portion thereof when in reclined position.

In another advantageous embodiment of the invention, the surfaces of the armrests forming the lying surface or portion thereof when the armrests are in reclined position are folded down approximately 90° from the upright position.

To mount the armrests both pivotably and displaceably on the base in a simple and cost-effective manner, it is advantageous if a stationary tube, or a like bearing element, is connected to the base, the former of which constitutes the third pivot axis and engages a guiding track, preferably realized as a slit, found in the armrest. If both axes are mounted pivotably on the base, then in this embodiment each armrest shall be connected to a tube. A rod or other longitudinal bearing element can be used according to preference. In a preferred embodiment the bearing element runs substantially throughout the entire extent of the armrest in axial relation to the bearing element.

In another embodiment of the invention, the armrest is pivoted and shifted perpendicularly to the first pivot axis by means of a common electromechanical adjustment drive.

The invention teaches that it is possible, however, to have a dedicated electromechanical adjustment drive to facilitate the pivoting of the armrest, while having another present specifically to facilitate the shifting of the armrest perpendicularly to the first pivot axis.

The invention is described in further detail below with reference being made to the schematic drawings, which illustrate embodiments of the inventive chair.

FIG. 6 illustrates a top view of chair as shown in. FIG. 1 with the upholstery removed;

In the Figures listed above, identical or corresponding components are labeled with the same number.

Figure 1:
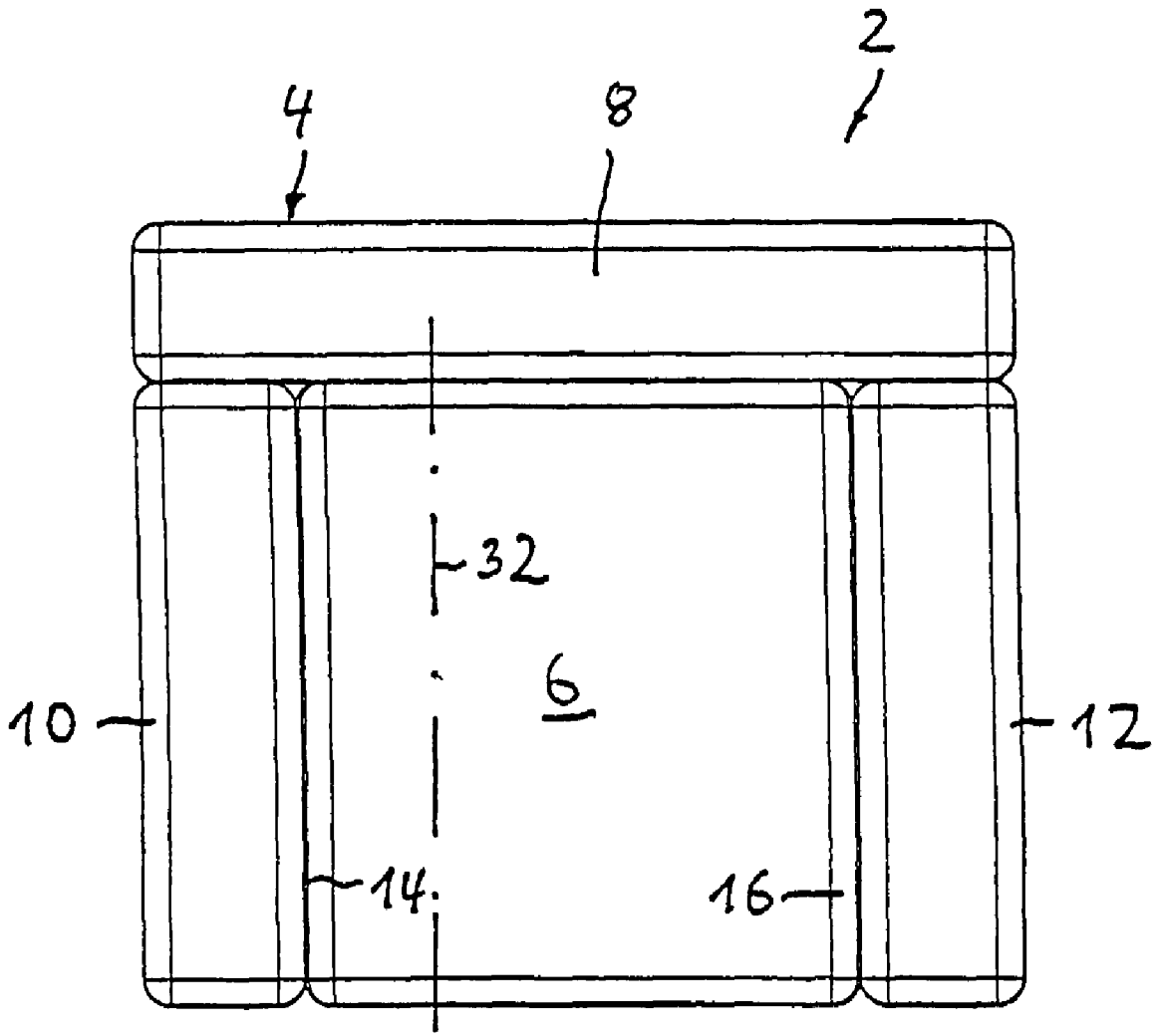
FIG. 1 illustrates a top view of a first embodiment of the inventive chair with the armrests in upright position.

FIG. 1 illustrates a first embodiment of a seating furniture 2 in the form of an arm chair, which features a base 4, on which a sitting surface 6 is formed. The base 4 further features a backrest 8. Mounted on the base 4 and placed laterally to the sitting surface 6 are armrests 10,12, which, according to the invention, can be adjusted, in a manner explained in further detail below, between an upright position illustrated in FIG. 1, in which the armrests 10,12 extend generally vertically, and a reclined position. As FIG. 1 demonstrates, the surfaces 14, 16 of the armrests 10, 12 facing one another in the upright position are substantially parallel to one another. To increase user comfort, the sitting surface 6 and the backrest 8 feature cushioning and suspension as described in further detail below.

Figure 2:
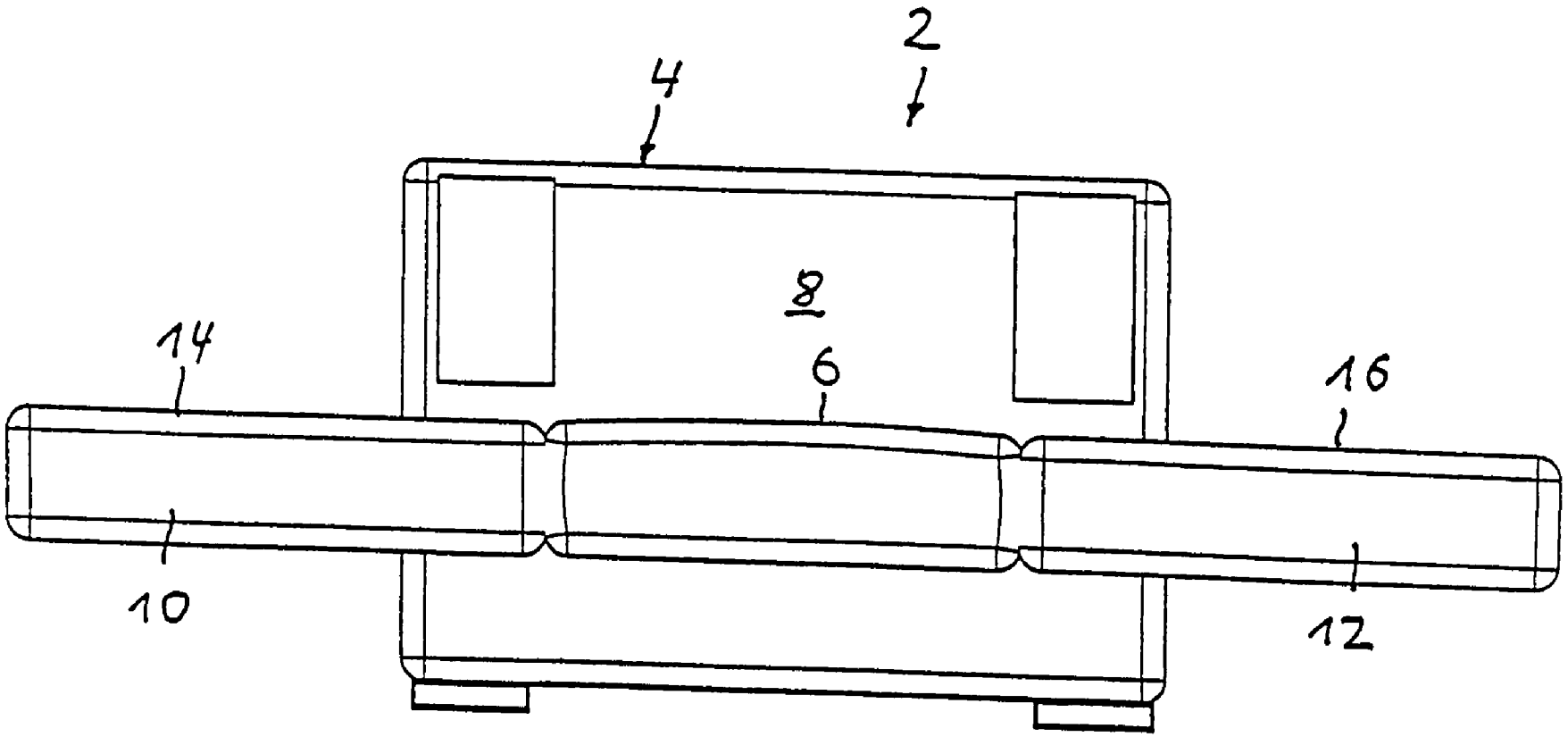
FIG. 2 illustrates a front view of the chair as shown in FIG. 1 with the armrests in reclined position.

FIG. 2 shows a frontal view of the seat 2 with the armrests 10, 12 in reclined position. When in reclined position, the armrests 14, 16 form together with the sitting surface 6 a lying surface, which includes a substantially flat surface in this embodiment. As a comparison between FIGS. 1 and 2 makes evident, the armrest 10, 12 surfaces 14, 16 facing one another when in the upright position and forming the lying surface in reclined position are folded down by approximately 90° from their upright position when in the reclined position.

To facilitate the adjustment of the armrests 10,12 from the upright position illustrated in FIG. 1 to the reclined position illustrated in FIG. 2, each armrest 10,12 is connected to an electromechanical adjustment mechanism, which is described immediately below in further detail with reference being made to FIG. 3.

Figure 3:
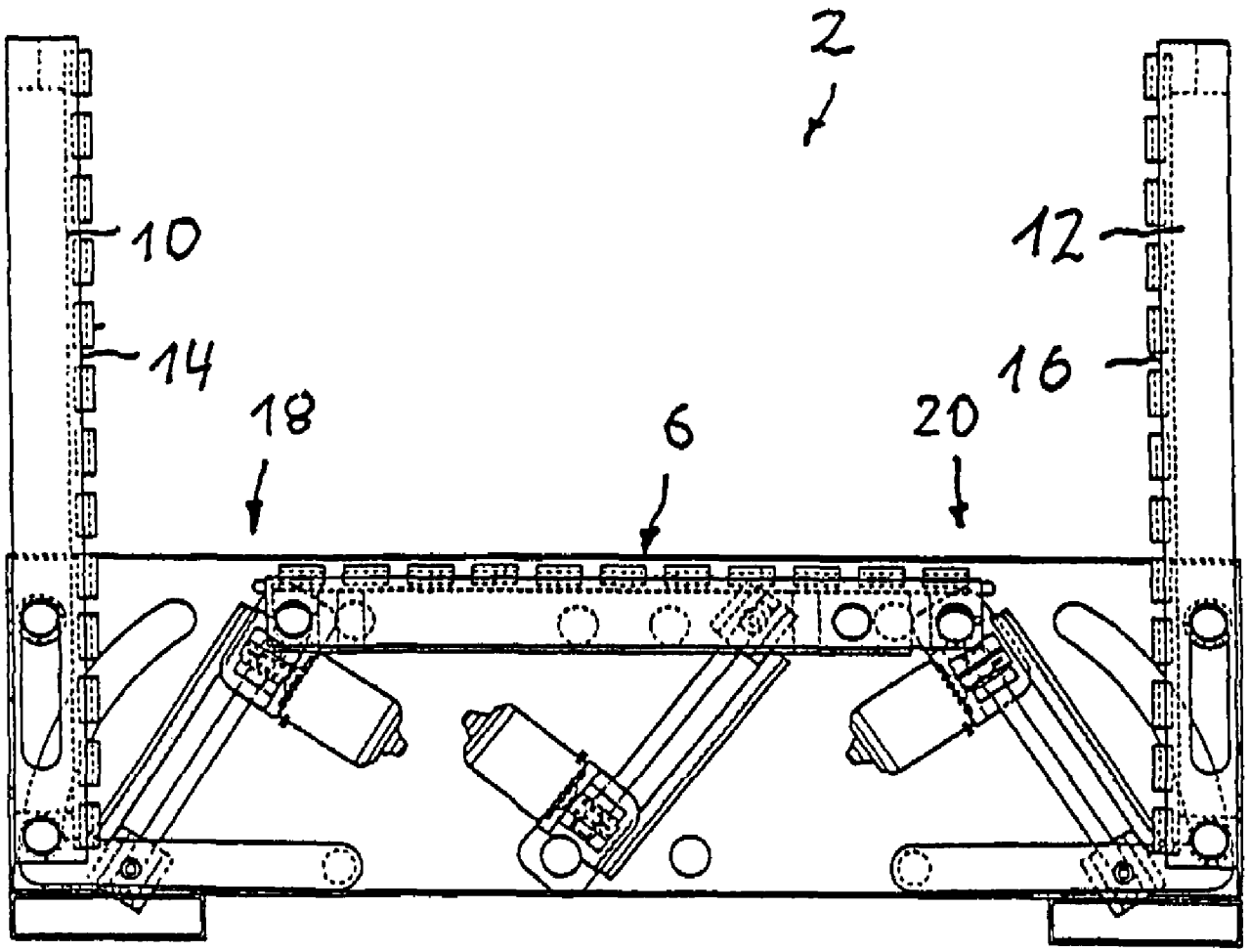
FIG. 3 illustrates a front view of the chair as shown in FIG. 1 with the armrests in upright position, wherein the upholstery and portions of the base are omitted to illustrate the adjustment mechanism.

FIG. 3 shows a frontal view of the seat 2 as shown in FIG. 1, wherein an electromechanical adjustment mechanism 18 connected to the armrest 10 and another electromechanical/electric motor adjustment mechanism 20 connected to armrest 12 are visible. Hereinafter only the electric motor adjustment mechanism 18 will be described in further detail. The electromechanical adjustment mechanism 20 has both the same construction and labeling of components as found in adjustment mechanism 18.

Figure 4:
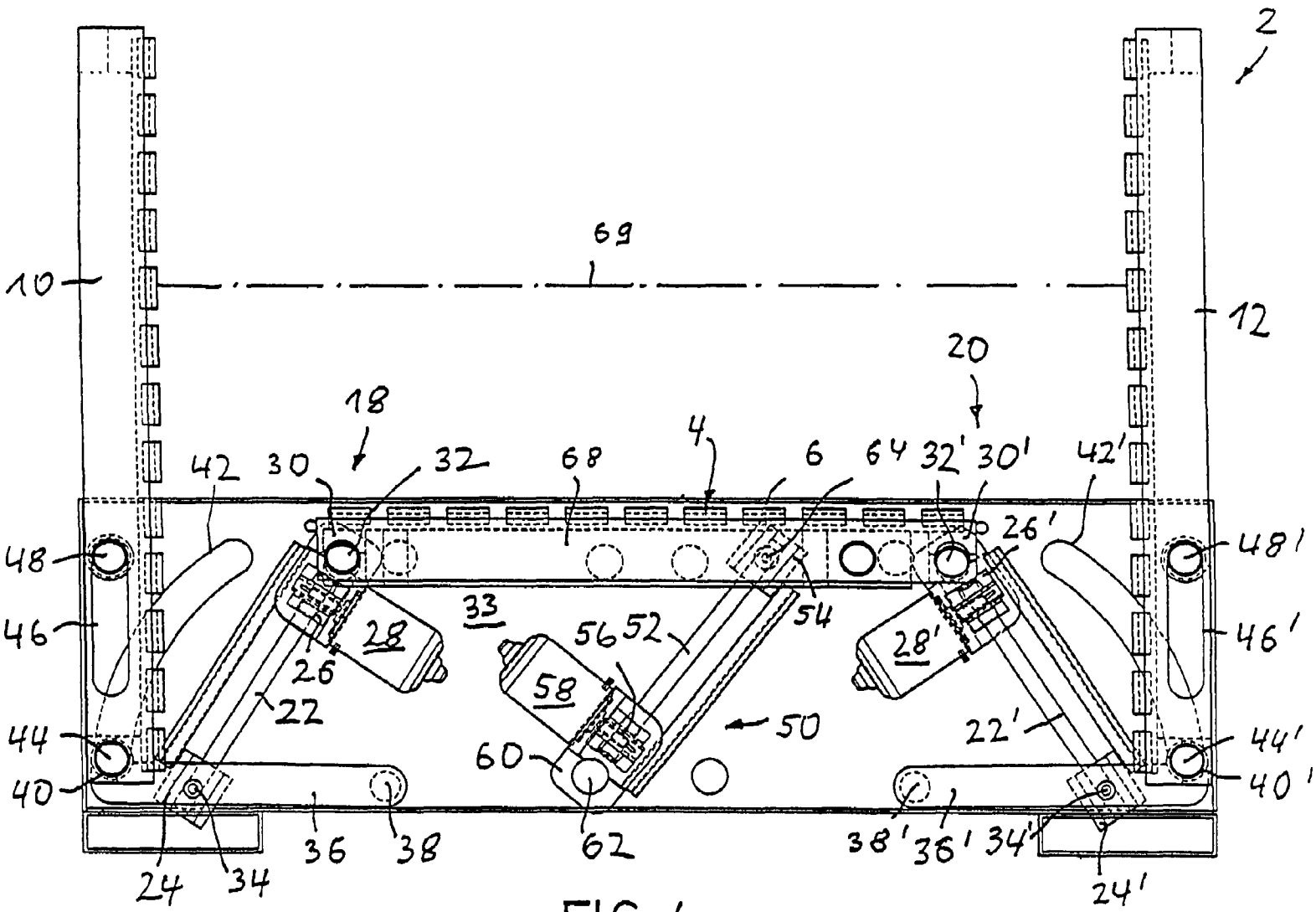
FIG. 4 illustrates a view as shown in FIG. 3 in larger scale.

FIG. 4 is a larger-scale version of the illustration shown in FIG. 3. The adjustment mechanism 18 features a spindle drive with a rotary driven threaded spindle 22, to which a spindle nut 24 is connected to the threaded spindle 22 and moves in axial relation thereto, the spindle nut 24 being secured against rotation. The spinning of the threaded spindle 22 is powered via a gearbox 26 by an electric motor 28. The threaded spindle 22 and the spindle nut 24 are connected together with the electric motor 28 to a bearing element 30, which is mounted pivotably about a horizontal pivot axis 32 (sixth pivot axis) to a portion 33 of the base 4 of the chair 2. A lever 36 is mounted pivotably about a horizontal pivotal axis to the spindle nut 24, wherein the one end of the lever is mounted pivotably about a pivot axis 38 (second pivot axis) fixed to a portion 33 of the base 4 to the portion 33 of the base 4. The other end of the lever 36 is connected to a tube 40, which, when the lever 36 is pivoted, moves into a slot 42 present in portion 33 of the base and forming an arc centered around pivot axis 38. In this embodiment, the tube 40 runs throughout the entire extent of the armrest 10 in the axial direction of the tube 40.

Armrest 10 is connected to the tube 40 pivotably around a horizontal pivot axis 44 (third pivot axis), wherein a straight slot 46 serving as a guiding track is present, in which a tube 48 runs, which is fixed to portion 33 of the base 4. In this embodiment the tube 48 runs throughout the entire extent of the armrest 10 in the axial direction of the tube 48.

To facilitate the adjustment of the armrest 10 from the upright position illustrated in FIG. 4 to the reclined position, an electric motor 28 drives the threaded spindle 22 in such a manner that the spindle nut 24 in FIG. 4 moves in axial direction along the threaded spindle 22 toward the electric motor 28. The lever 36 is hereby pivoted clockwise around the pivot axis 38 shown in FIG. 4. The armrest 10 is hereby pivoted counterclockwise about a pivot axis formed by tube 48 (first pivot axis) shown in FIG. 4, wherein the armrest 10 is tracked longitudinally along the slot 46 relative to the tube 48.

As the adjustment progresses, the armrest 10 pivots about the pivot axis formed by the tube 48, while at the same time displaying a linear translation movement along an imaginary straight line between the first pivot axis 48 and the third pivot axis 44, so that the end of the armrest 10 facing away from the adjustment mechanism 18 is shifted to the left portion of the illustration during adjustment. The kinematics employed allow the top surface of the armrest 10 to be at the same height as the sitting surface 4 when the former is in reclined position and at the same time allow the lying surface of the armrest 10 to tightly adjoin with the sitting surface 4 longitudinally.

Figure 5:
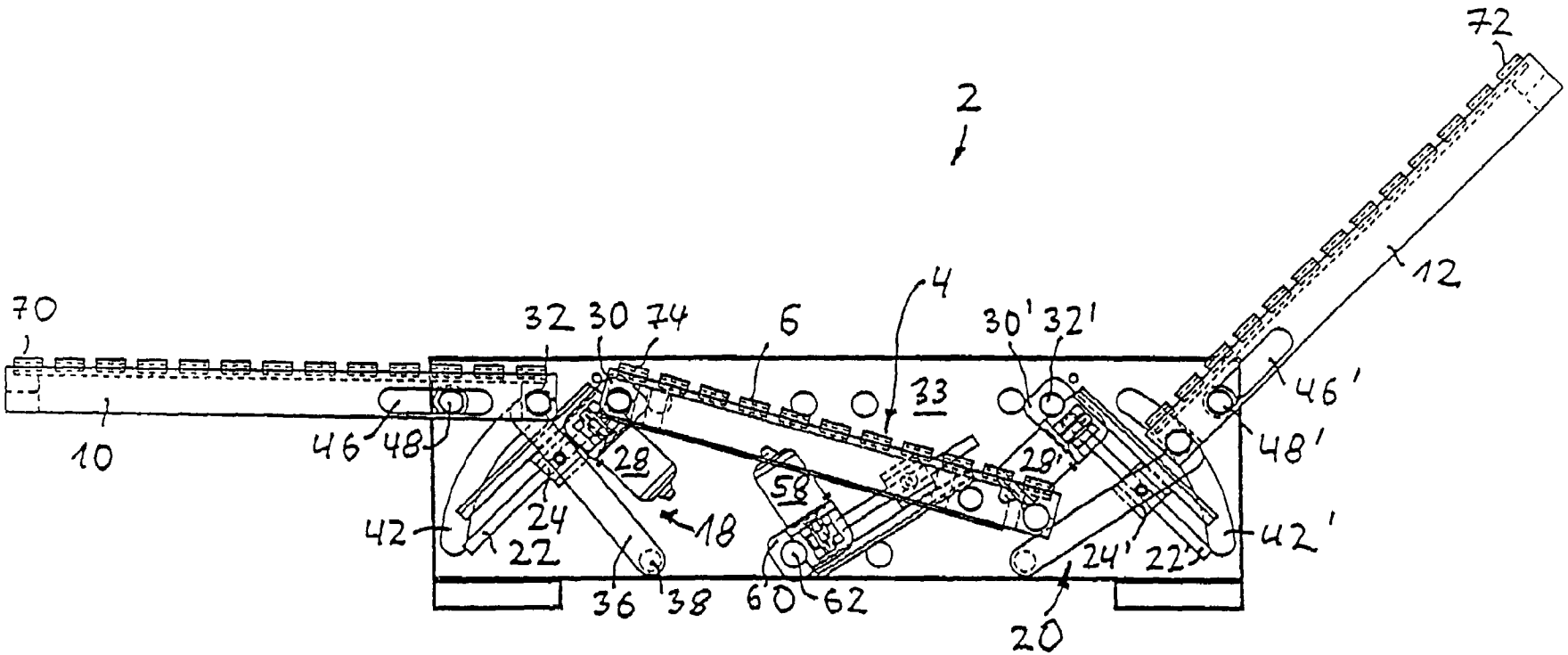
FIG. 5 illustrates in the same manner as FIG. 3, the chair as shown in FIG. 3 with the armrests in adjusted position.

FIG. 5 shows the armrest 10 in the final adjustment setting, in which the armrest 10 is in reclined position.

The adjustment of armrest 12 from the upright position illustrated in FIG. 4 to the reclined position follows the same process as that described above, with FIG. 5 showing an adjustment setting in which the armrest 12 is horizontally tilted below an angle of 45°.

To facilitate adjustment of the pitch of the sitting surface 6, an additional electric motor adjustment mechanism 50 is present, which includes a spindle drive with a threaded spindle 52, to which a spindle nut 54 is connected, wherein the spindle is secured against rotation and movable in axial relation thereto. The rotating of the threaded spindle 52 is powered via a gearbox 56 by an electric motor 58. The threaded spindle 52 is, together with the electric motor 58, attached to a bearing element 60, which is mounted pivotably about a horizontal pivot axis 62 to portion 33 of the base 4. The spindle nut 54 is connected flexibly and pivotably about a horizontal pivot axis 64 to one of the supports 68 forming the sitting surface 6, wherein the end of the support facing away from the pivot axis 64 is mounted pivotably about the pivot axis 32 to portion 33 of the base 4.

To adjust the pitch of the seat portion 68 forming the sitting surface 4 the electric motor 58 drives the threaded spindle 52 in such a manner that the spindle nut 54 moves in axial relation to the threaded spindle 52 toward the electric motor 58. The support 68 is thereby pivoted clockwise about the pivot axis 32 (fourth pivot axis) in FIG. 4, wherein the bearing element 60 in FIG. 4 simultaneously pivots clockwise about the pivot axis 62. In this manner the pitch of the support 68 forming the sitting surface 4 is adjusted, as can be seen by comparing FIGS. 4 and 5. As FIG. 4 shows, the pivot axis 32 in FIG. 4 runs beyond the drawing plane and is therefore perpendicular to an imaginary line 69 spanning the distance between the armrests 10,12. Furthermore the pivot axis 32 is perpendicular to the backrest 8 present on the drawing plane but not illustrated in FIG. 4. This is also visible in FIG. 1, in which the pivot axis 32 is represented by a dot-dash line.

As FIG. 5 demonstrates, the adjustment setting illustrated in FIG. 5 forms a resting position in which the armrest 10 is substantially horizontal, while the support 68 and the armrest 12 form a concave portion of the cross section of lying surface.

To bring the armrest 12 into reclined position, the electric motor 28' drives the threaded spindle 22' in such a manner that the spindle nut 24' in FIG. 5 moves into the particular position, in which its distance from the electric motor 28' is minimal. In this reclined position the armrest 12 is substantially horizontal.

To bring the sitting surface 4 into reclined position, the electric motor 58 drives the threaded spindle 52 in such a manner that the spindle nut 54 moves back into the position illustrated in FIG. 4, in which the sitting surface 4 is substantially horizontal and together with the surfaces of the armrests 10, 12 described above forms a substantially level, horizontal lying surface.

As FIG. 4 demonstrates, the tube forming the pivot axis 48 is at the end of the track 46 closer to the free end of the armrest 10, when the armrest 10 is in upright position. When the armrest 10 pivots from the upright position illustrated in FIG. 4 to the reclined position illustrated in FIG. 5, the armrest 10 shifts relative to the tube 48 until the tube 48 is at the end of the track further removed from the free end of the armrest 10 as FIG. 5 illustrates for armrest 12. As the adjustment movement proceeds the tube again shifts relative to the track in the direction of the end of the track 46 closer to the free end of the armrest 10, until the adjustment position illustrated in FIG. 5 is achieved where the armrest 10 is placed in reclined position.

The armrests 10, 12 are cushioned by a suspension means on their surfaces forming the lying surface when set in reclined position, wherein in this embodiment the suspension means are elastic slats, of which only one slat labeled 70 and 72 is illustrated in FIG. 5. In this embodiment the suspension means is embodied as a type of slatted frame and thereby offers a high level of comfort and support. The support 68 forming the sitting surface 4 also features elastic slats, of which only one slat is referenced in FIG. 5 by reference numeral 74. The sitting surface is therefore also embodied as a type of slatted frame. Furthermore, armrests 10,12 as well as sitting surface 6 feature cushioning, which is not illustrated in FIG. 5, on their surfaces forming the lying surface in relined position.

The inventive chair can be adjusted in a quick and simple manner between the upright position and the reclined position. It can therefore be used either as a chair or bed as needed. Because the armrests can be directly adjusted between the upright and reclined position, the inventive chair 2 offers a wide array of adjustment possibilities.

Figure 6:
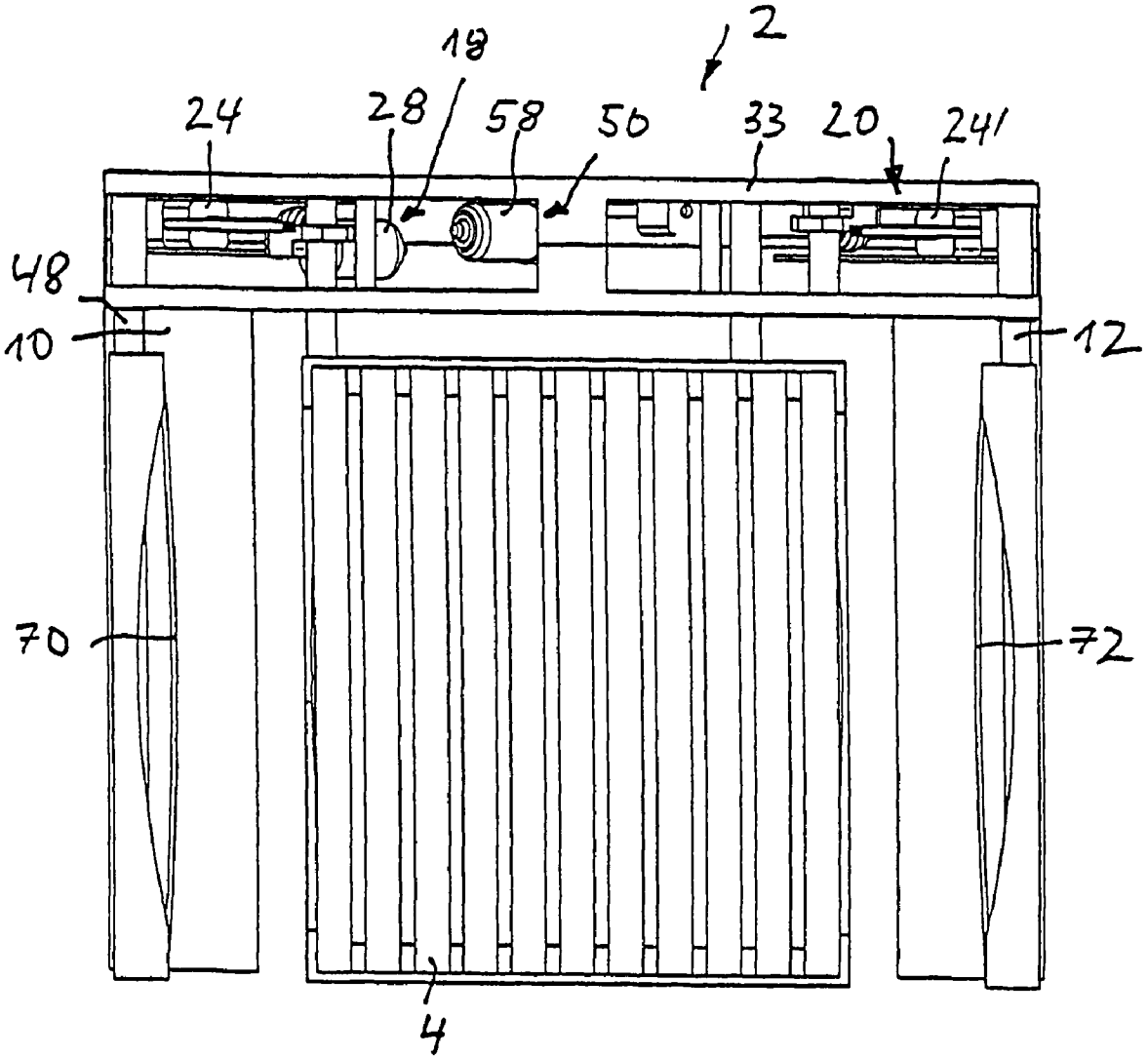

FIG. 6 shows a top view of the chair 2 with the upholstery omitted. The illustration shows that the adjustment mechanisms 18, 20, 50 are located in the backrest 8, which is hollow.

Figure 7:
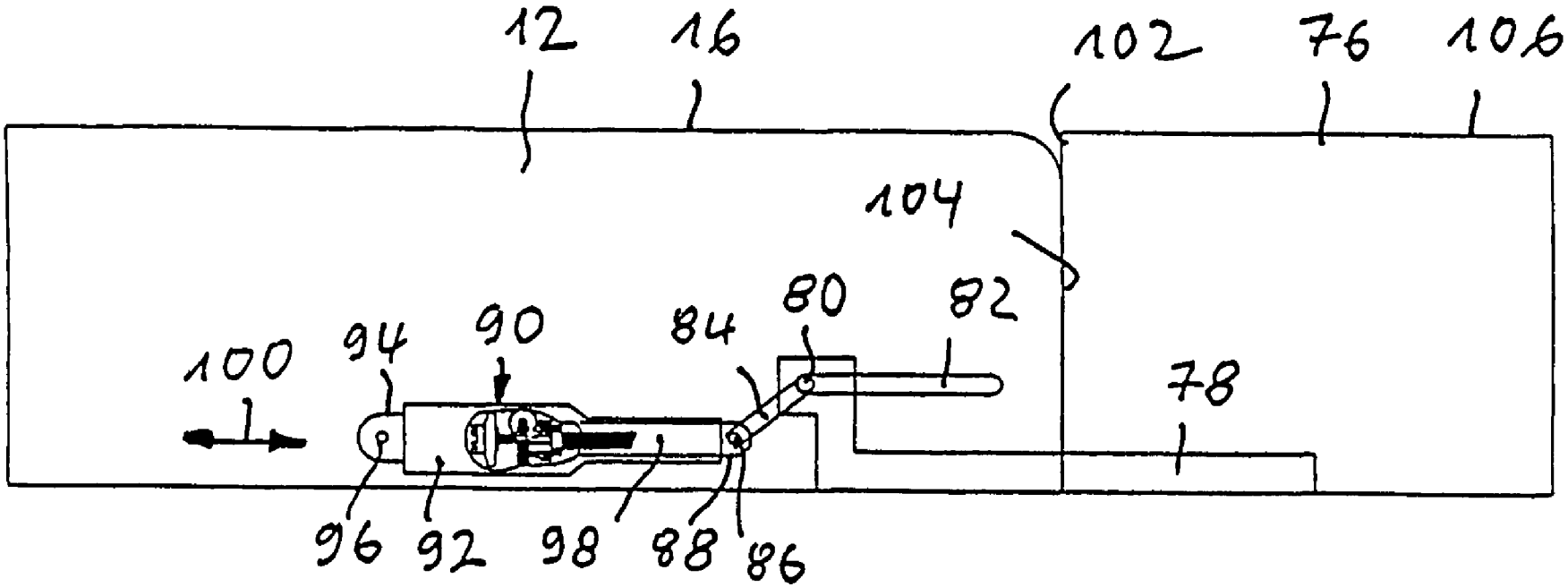
FIG. 7 illustrates a schematic front view of a second embodiment of the inventive chair, wherein parts of an adjustment mechanism for adjusting a support relative to the armrest are set in first position.

FIG. 7 shows an armrest 12 of a second embodiment of an inventive chair 2, which distinguishes itself from the embodiment shown in FIG. 1 in that a support 76 that can be adjusted relative to the armrest 12 is connected to the end of the armrest 12 facing away from the sitting surface 6. The support 76 is connected via a lever-like connection element 78 to bolt 80, which runs through a guiding track present in armrest 12, realized in this embodiment as a straight slot 82.

An end of the single-armed lever 84 is fixedly connected to the bolt with the other end being connected pivotably about a horizontal pivot axis 86 to a linkage 88 of an adjustment mechanism 90. The adjustment mechanism 90 features a housing 92, which is connected pivotably about a horizontal pivot axis 96 to the armrest 12. The adjustment mechanism 90 also features a telescoping adjustment element 98 contained in the housing 92, which can be adjusted by electric motor in the direction of a double-arrow out of the housing 92 or back into the housing 92.

FIG. 7 shows a first setting in which the one face 102 of the support 76 abuts a face 104 of the armrest 12 and an upper surface 106 of the support 76 forms together with the upper surface 16 of the armrest 12 horizontal, level support surface.

The adjustment mechanism 90 and its connected components are housed in the inside of the armrest 12, which for this purpose is at least partly hollow.

To facilitate the movement of the adjustment element 98 relative to the housing 92, the adjustment mechanism 90 features an electric motor, which actuates via a gearbox and a spindle drive an adjustment element 98 in such a manner that depending on the rotational direction of the drive shaft of the electric motor, the adjustment element either extends from the housing 92 or retracts into the housing 92.

To adjust the support 76 relative to the head support 12, the adjustment mechanism 90 is activated, causing the adjustment element 98 to extend from the housing 92. The bolt 80 hereby slides linearly into the track 82 in the first phase of the adjustment, so that the connection element 78 and thereby the support 76 extend in a linear translation movement in the direction of the track 82, as FIG. 8 demonstrates.

Figure 8:
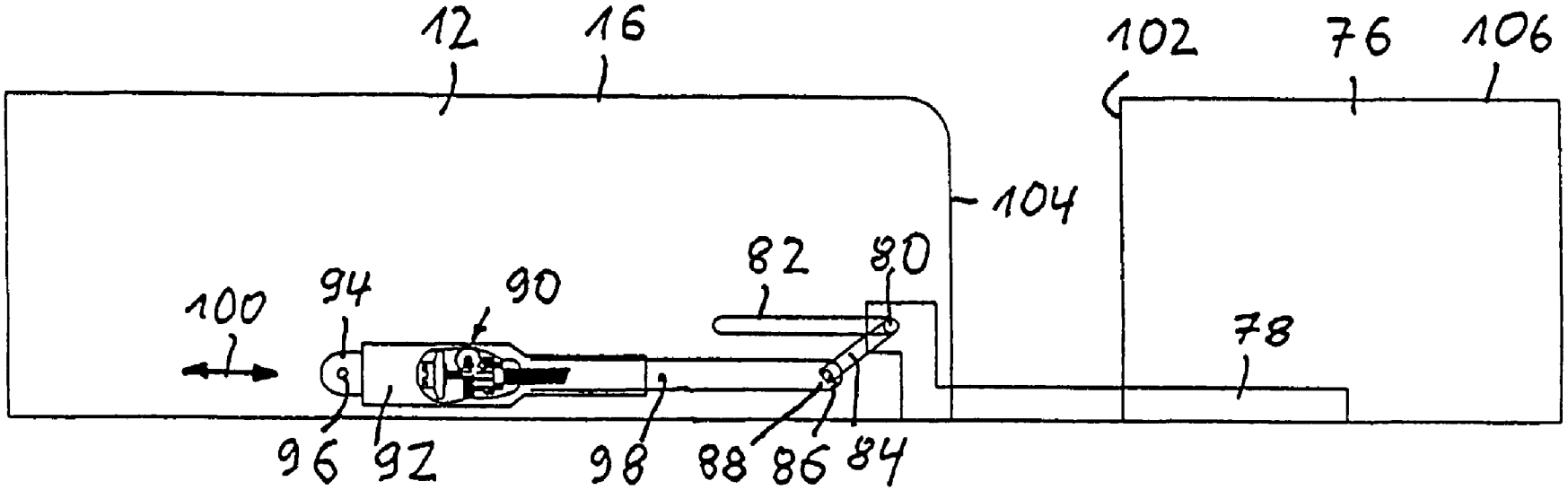
FIG. 8 illustrates an armrest as shown in FIG. 7 in second position.

In the adjustment position illustrated in FIG. 8, the bolt 80 is present at a stop housed in the track 82 or formed through the end of the track present in the direction of the track bearing so that a further translation movement of the connection element 78, and thereby support 76, is prevented.

Figure 9:
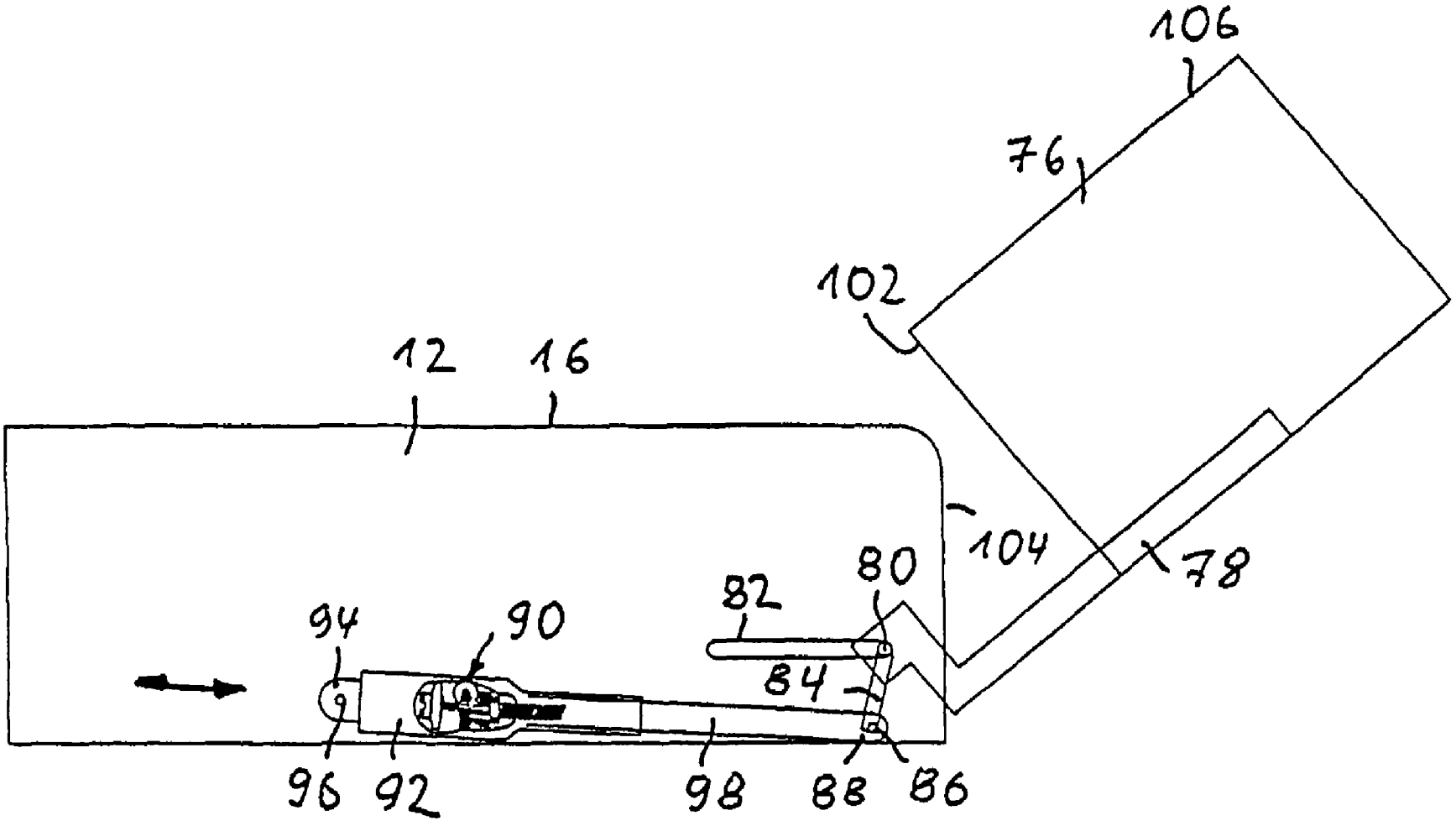
FIG. 9 illustrates an armrest as shown in FIG. 7 in third position.

If the adjustment element 98 in FIG. 8 moves any further to the right, the lever 84 will pivot counterclockwise according to the illustration, as is shown in FIG. 9. Owing to the fixed connection of the lever 84 to the connection element 78 the support 76 will thereby pivot counterclockwise. In the adjustment position illustrated in FIG. 9 the upper surface 106 of the support 76 is tilted relative to the upper surface 16 of the armrest 12, so that the support 76 can serve, for example, as a neck support for a person resting on chair 2.

Figure 10:
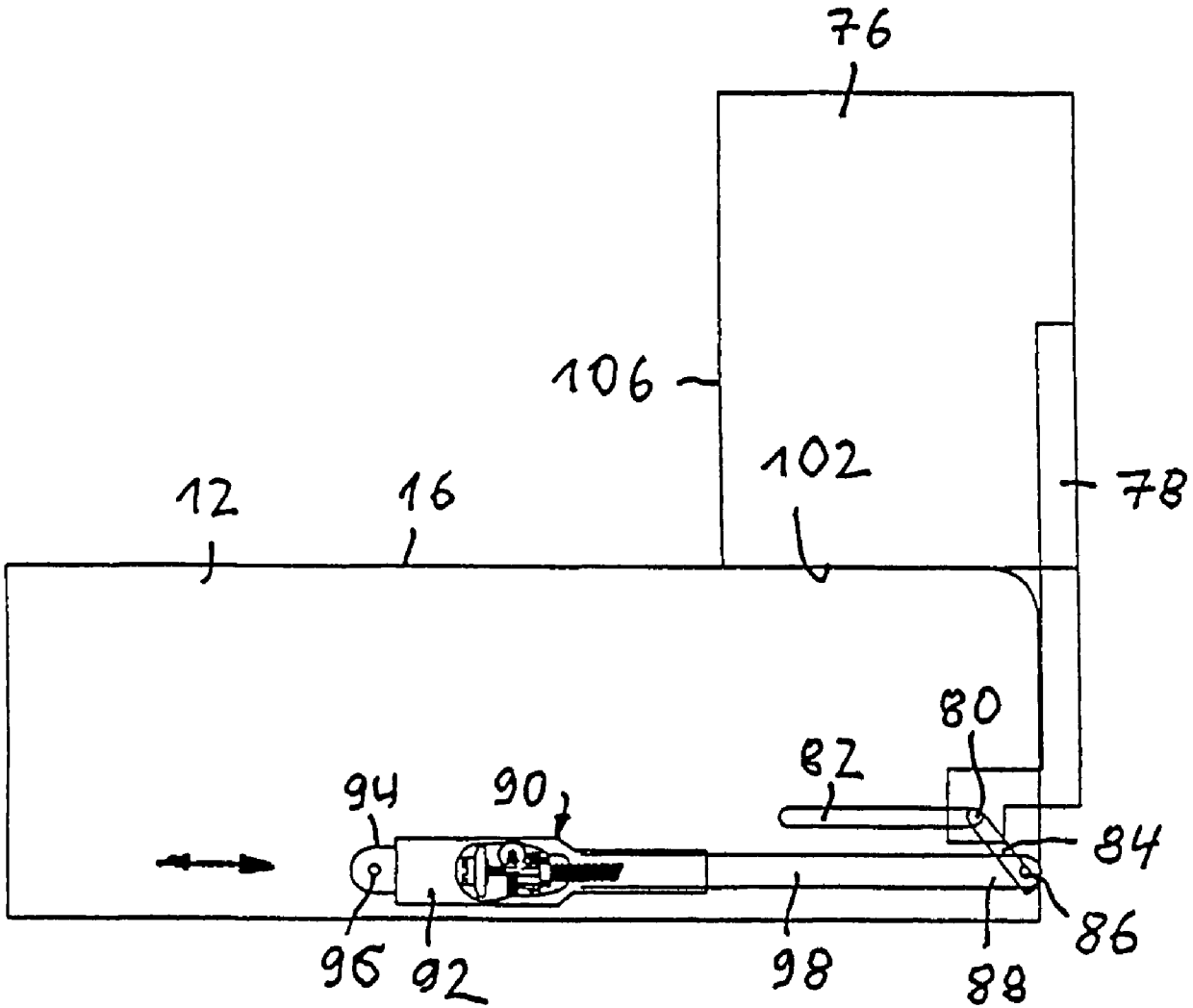
FIG. 10 illustrates an armrest as shown in FIG. 7 in fourth position.

If the adjustment element 98 in FIG. 9 moves any further to the right, the lever 84, and thereby the support 76, will pivot via the connection element 78 further counterclockwise according to the illustration until the face 102 of the support 76 overlies the upper surface 16 of the armrest 12, as is shown in FIG. 10.

Figure 11:
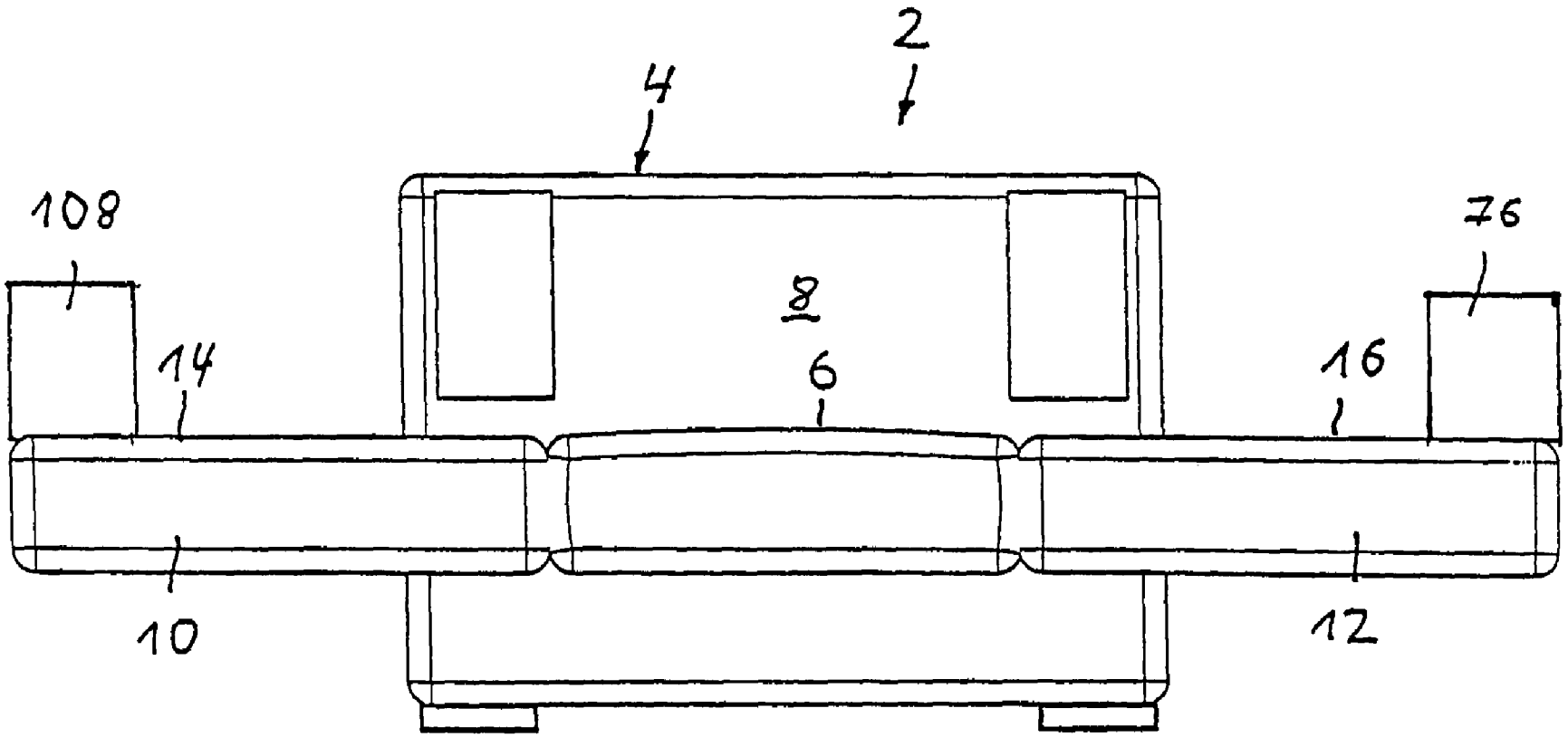
FIG. 11 illustrates a second embodiment of the inventive chair illustrated as in FIG. 2.

FIG. 11 shows the second embodiment of the inventive chair 2 with the armrest 12 as shown in FIG. 10. The armrest 10 also features a support 108, wherein the construction and the connection to the armrest 10 are identical to that of support 76 and armrest 12. In the adjustment position illustrated in FIG. 11, in which the supports 76,108 are bent relative to the respective back supports 10 and 12 to which they are connected, the seat 2 forms a loveseat. In this embodiment, the adjustment possibilities are once again expanded beyond those of the embodiment illustrated in FIG. 1.

Figure 12:
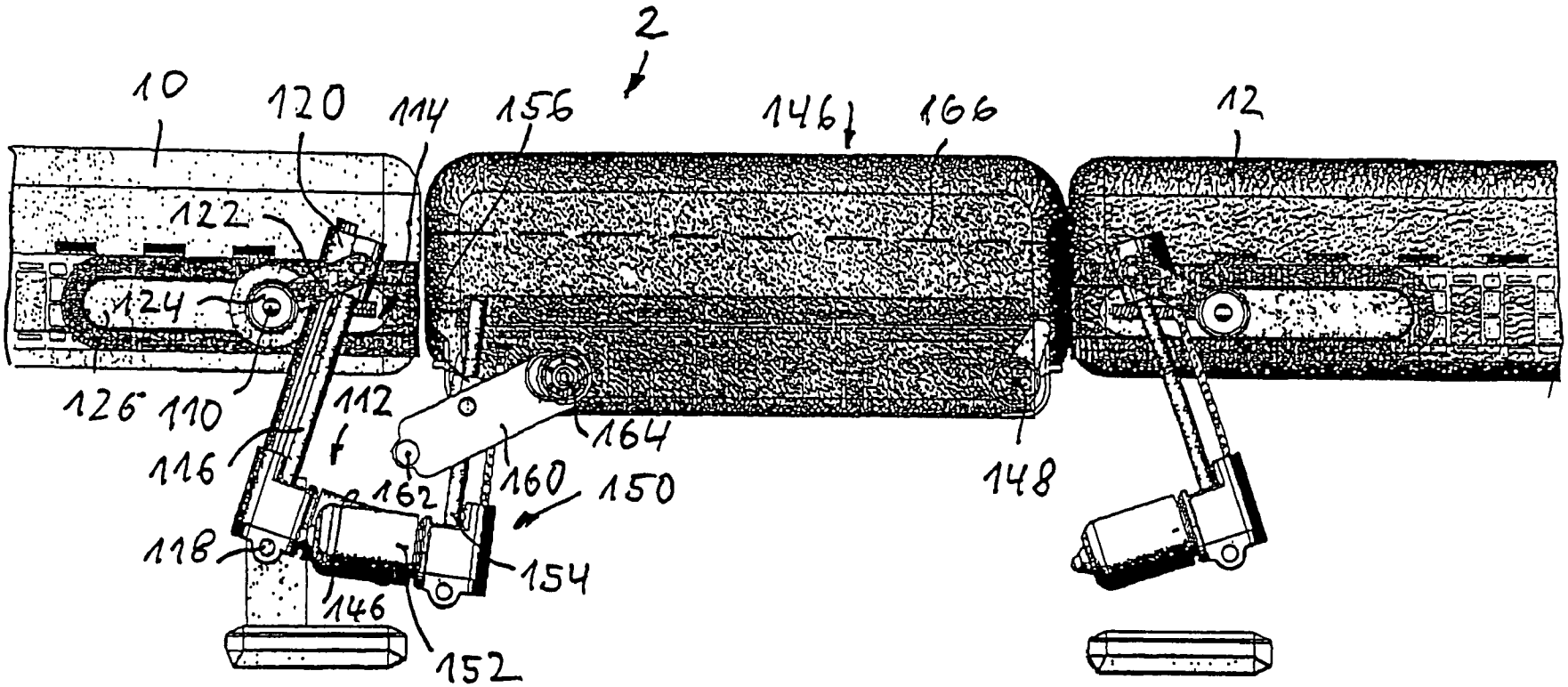
FIG. 12 illustrates a schematic side view of a third embodiment of the inventive chair with portions of cushioning and base omitted, in first position.

FIG. 12 illustrates a third embodiment of an inventive chair 2, which distinguishes itself from the embodiment shown in FIG. 1 primarily in that a separate electric motor adjustment drive is present for pivoting the armrest 10, while another is present for shifting the armrest 10 perpendicularly to the first pivot axis.

Figure 14:
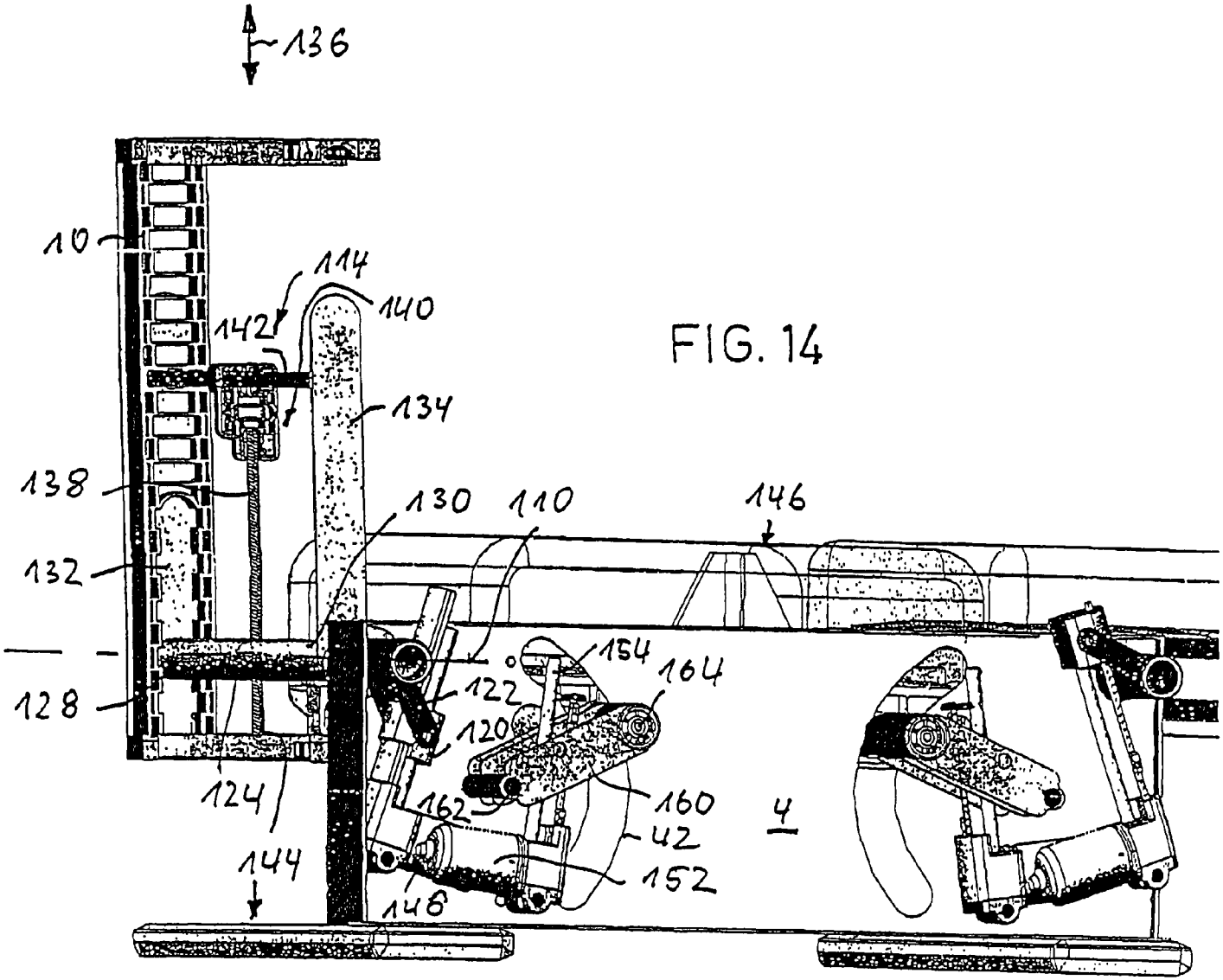
FIG. 14 illustrates a perspective illustration of the chair as shown in FIG. 12.

A first electric motor adjustment drive 112 is present to pivot the armrest about a substantially horizontal first pivot axis 110, while a second electric motor drive 114, which is further detailed below with reference made to FIG. 14, is present to facilitate linear and/or translatory shifting of the armrest 10 in perpendicular relation to the first pivot axis 110.

To facilitate the pivoting and shifting of the armrest 12, separate electric motor adjustment drives are present, the function of which is identical to that of the electric motor adjustment drives 112,114 and is therefore not explained in further detail.

The first electric motor adjustment drive 112 is realized as a spindle drive and features a threaded spindle 116, which is connected to a fixed base (not shown in FIG. 12) of the chair 2 pivotably about a substantially horizontal pivot axis 118 parallel to the first pivot axis. A spindle nut 120 is connected to the threaded spindle 116 and movable in axial relation to the threaded spindle 116, wherein the spindle nut 120 is secured against rotation. The spindle nut is connected pivotably to an end of the lever 122, the other end of which is connected fixedly to one of the pivot shafts 124 forming the first pivot axis 110. The pivot axis is connected to the armrest 10 in a non-rotating manner yet displaceably in the direction of one of the slits 126 forming the track.

The nature of the displaceable connection between the pivot shaft 124 and the armrest 10 and the function of the second electric motor adjustment drive 114 are explained below with reference made to FIG. 14.

FIG. 14 is a perspective illustration, wherein parts of the armrest 10 and the base 4 of the chair are omitted for clarity. Block-like track elements 132,134 are connected in a non-rotating manner to the ends 128,130 of the pivot shaft 124, wherein the armrest 10 is mounted to the track element substantially perpendicular to the first pivot axis 110 and displaceable in the direction of a double-arrow 136.

The second electric motor adjustment drive 114 features a rotary-driven threaded spindle, which is powered by an electric motor (not illustrated) via a gearbox 140. The threaded spindle 138 is perpendicular to the first pivot axis 110. The gearbox 140 and the electric motor are connected to a brace 142, which is perpendicular to the threaded spindle 138 and is connected non-displaceably to the armrest 10. The end 144 of the threaded spindle 138 facing away from the gearbox is connected to the armrest 10 via a pivot bearing.

The pivot shaft 124 features a coaxial clearance for the threaded spindle 138 running substantially perpendicular to the first pivot axis 110, to in which a spindle nut (not visible in the drawing) is mounted in a non-rotating manner and rests on the threaded spindle 138.

The adjustment of the armrest 10 is explained in further detail below with reference being made to FIGS. 12 and 14.

Figure 13:
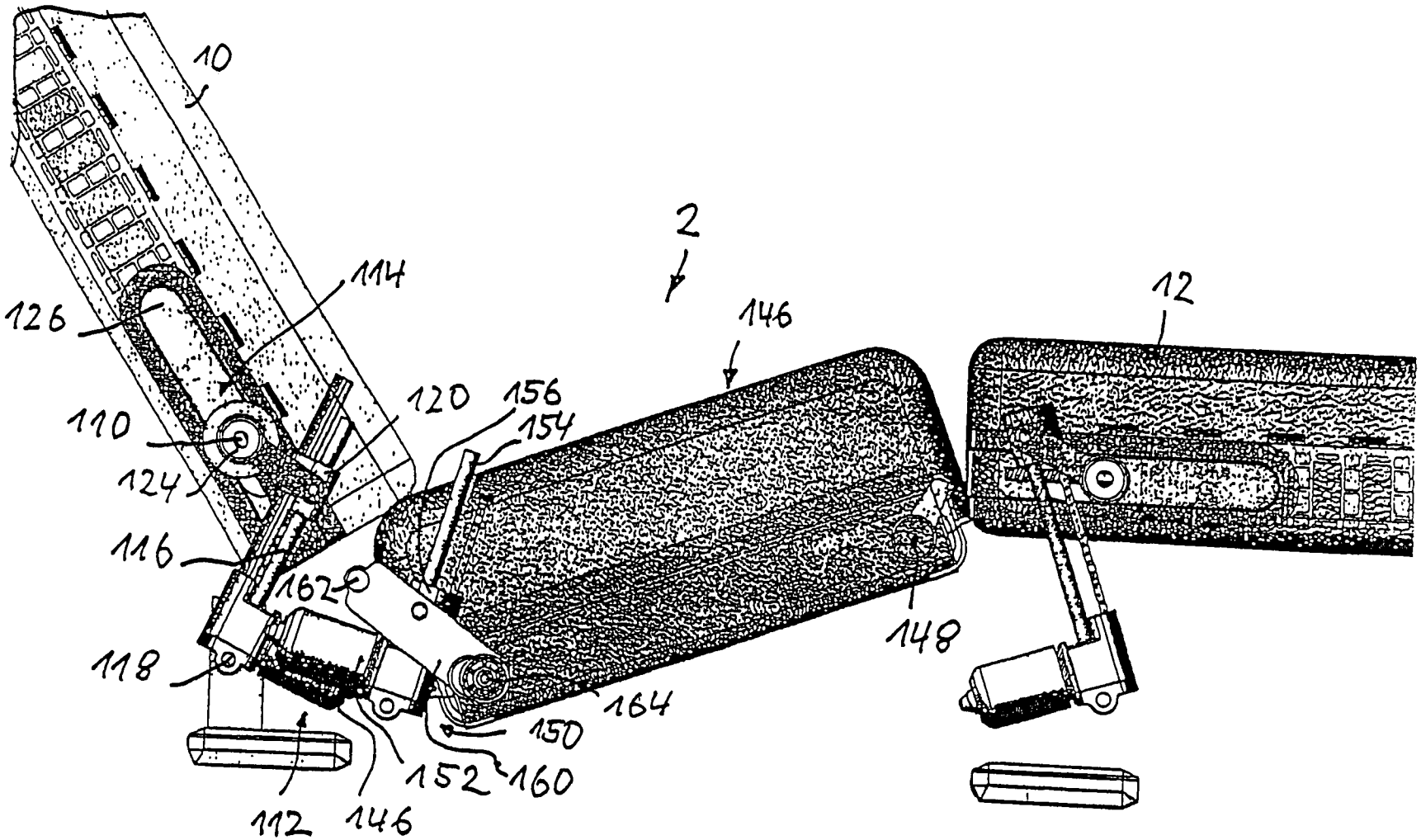
FIG. 13 illustrates a chair as shown in FIG. 12 in a second setting and illustrated as in FIG. 12.

To pivot the armrest 10 about the first pivot axis 110 from the first end position of the adjustment process illustrated in FIG. 12 to the second end position of the adjustment process illustrated in FIG. 13, an electric motor 146 of the first electric motor adjustment drive 112 drives the threaded spindle in such a manner that the spindle nut 120 shown in FIG. 12 rotates downward and thereby pivots the lever 122 shown in FIG. 12 clockwise. Owing to the non-rotating connection of the lever 122 with the pivot shaft 124 and the non-rotating connection of the pivot shaft 124 with the armrest 10, the armrest 10 shown in FIG. 12 is pivoted clockwise. Although not visible in the illustration, the shaft 124 is pivotably mounted to the base of the chair.

At the same time, the electric motor of the second electric motor adjustment drive unit 114 (not shown) drives the threaded spindle 138 in such a manner that both the threaded spindle 138 and, owing to the non-displaceable connection of the threaded spindle 138 to the armrest 10, the armrest 10 shift relative to the pivot shaft 125, wherein the pivot shaft 124 slides in the track 126 present in the armrest.

During adjustment in this embodiment the armrest 10 thereby moves pivotably about the first pivot axis 110 while at the same time engaging in a linear translation movement perpendicular to the first pivot axis.

As apparent from FIG. 12, in the adjustment position illustrated in FIG. 12 the pivot shaft 124 is remote from the ends of the track 126. When moving from the first adjustment position illustrated in FIG. 12 to the adjustment position illustrated in FIG. 13 the pivot shaft 124 first moves in the track 126 in the direction of the seat portion 146, on which the sitting surface is formed, closest to the end of the track 126. When moving from the adjustment position shown in FIG. 13 to a second adjustment position, in which the armrest 10 is substantially vertical, the pivot shaft 124 moves in the track 126 in the direction of the end of track 126 facing away from the seat portion 146. The kinematics of the embodiment illustrated in FIG. 12 are therefore substantially identical to the kinematics of the embodiment illustrated in FIG. 1.

To ensure that the kinematics achieved by mechanical guidance and present in the embodiment illustrated in FIG. 1 are also achieved in the embodiment illustrated in FIG. 12, in which the pivoting of the armrest 10 about the first pivot axis 110 and the shifting perpendicular to the pivot axis 110 are facilitated by separate electric motor adjustment drives 112,114, a control means is present, which controls the first electric motor adjustment drive 112 and the second electric motor adjustment drive 114 in a coordinated manner by means of a control program. In this connection the control program is selected according to the desired kinematics to prevent the first electric motor adjustment drive 112 and the second electric motor adjustment drive 114 from canceling out each other and to achieve the desired kinematics. To ensure a coordinated activation of the electric motor adjustment drives 112,114 even after the power is switched off or during a power outage, the control means has a non-volatile memory, in which the control program is stored.

In the embodiment shown in FIG. 12 the seat portion 146 is mounted pivotably about a fourth pivot axis 148, which in this embodiment is substantially parallel to the first pivot axis 110. To facilitate the adjustment of the seat portion 146 relative to the armrests 10,12 and the base, the seat portion 146 is connected to an electric motor pivot drive, which features a third electric motor adjustment drive 150. The third electric motor adjustment drive 150 features an electric motor 152, which actuates a gearbox (not illustrated) with a rotary driven threaded spindle 154. A spindle nut 156 is connected in a non-rotating manner to the threaded spindle 154 and movable in axial relation thereto, wherein a two-armed lever 160 is connected pivotably about a horizontal pivot axis to the threaded spindle removed from its ends. One end of the two-armed lever 160 is connected pivotably about a horizontal pivot axis 162 to the base 4, while the other end of the two-armed lever 160 is connected pivotably about a horizontal pivot axis 164 and remote from the fourth pivot axis 148 to the seat portion 146.

As FIG. 12 shows, the fourth pivot axis 148 is substantially perpendicular to an imaginary line spanning the distance between the armrests 10, 12 and drawn as a dot-dash line 166 in FIG. 12.

To move the seat portion 146 from the adjustment position illustrated in FIG. 12 to an adjustment position illustrated in FIG. 13, the electric motor 152 drives the threaded spindle 154 in such a manner that the spindle nut 156 in FIG. 12 moves downward. As a result, the two-armed lever 160 pivots clockwise about the pivot axis 162 in FIG. 12, thereby causing the seat portion 146 in FIG. 12 to pivot counterclockwise about the fourth pivot axis 148.

Control of the third electric motor adjustment drive 150 is facilitated by a control means, which is not illustrated. The third electric motor adjustment drive can hereby be controlled independent of the first electric motor adjustment drive 112 and/or the second electric motor adjustment drive 114. The activation of the third electric motor adjustment drive 150 can however also be coordinated with the activation of the first electric motor adjustment drive 112 and/or the second electric motor adjustment drive 114.

FIG. 12 shows the chair in reclined position, where the armrests 10, 12 together with the seat portion 146 form a substantially continuous and horizontal lying surface, so that a bed is formed in this position. In the upright position of the chair, the armrests 10, 12 are perpendicular relative to the seat portion, as shown, for example, in FIG. 4, in accordance with the embodiment shown in FIG. 1. The control means of the chair is constructed in such a manner that desired positions between the reclined position and the upright position can also be selected, whereby the different adjustment drives can be activated independently of one another or at least partly dependent on one another according to the desired kinematics.

FIG. 13 shows a position in which the armrest 12 is substantially horizontal, while the seat portion 146 is slightly pivoted counterclockwise about the pivot axis 148 relative to the armrest 12 and the armrest 12 is pivoted clockwise about the pivot axis relative to the seat portion 146. This position constitutes a reclined position as is found in adjustable slatted frames or similar structures. The illustration demonstrates that in this reclined position the legs of a person resting on the chair are supported by the armrest 12, while the buttocks are supported by seat portion 146 and the back is supported by the armrest 10. In this setting, the resting person is reclined 90° from the setting illustrated in FIG. 4 of the embodiment as shown FIG. 1

Figure 15:
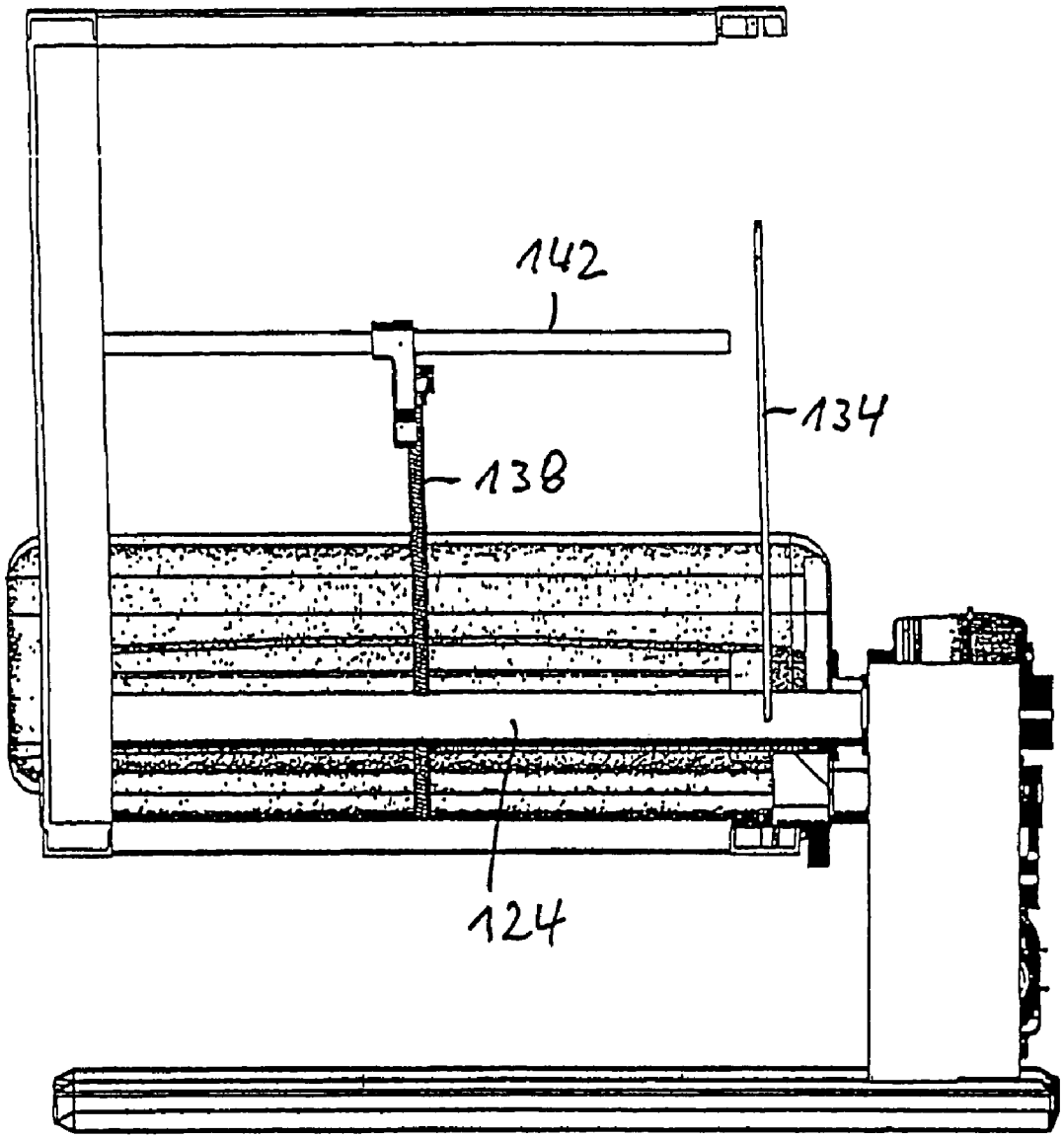
FIG. 15 illustrates a portion of the chair as shown in FIG. 12.

FIG. 15 is a side view of the armrest with the upholstery omitted.

Figure 16:
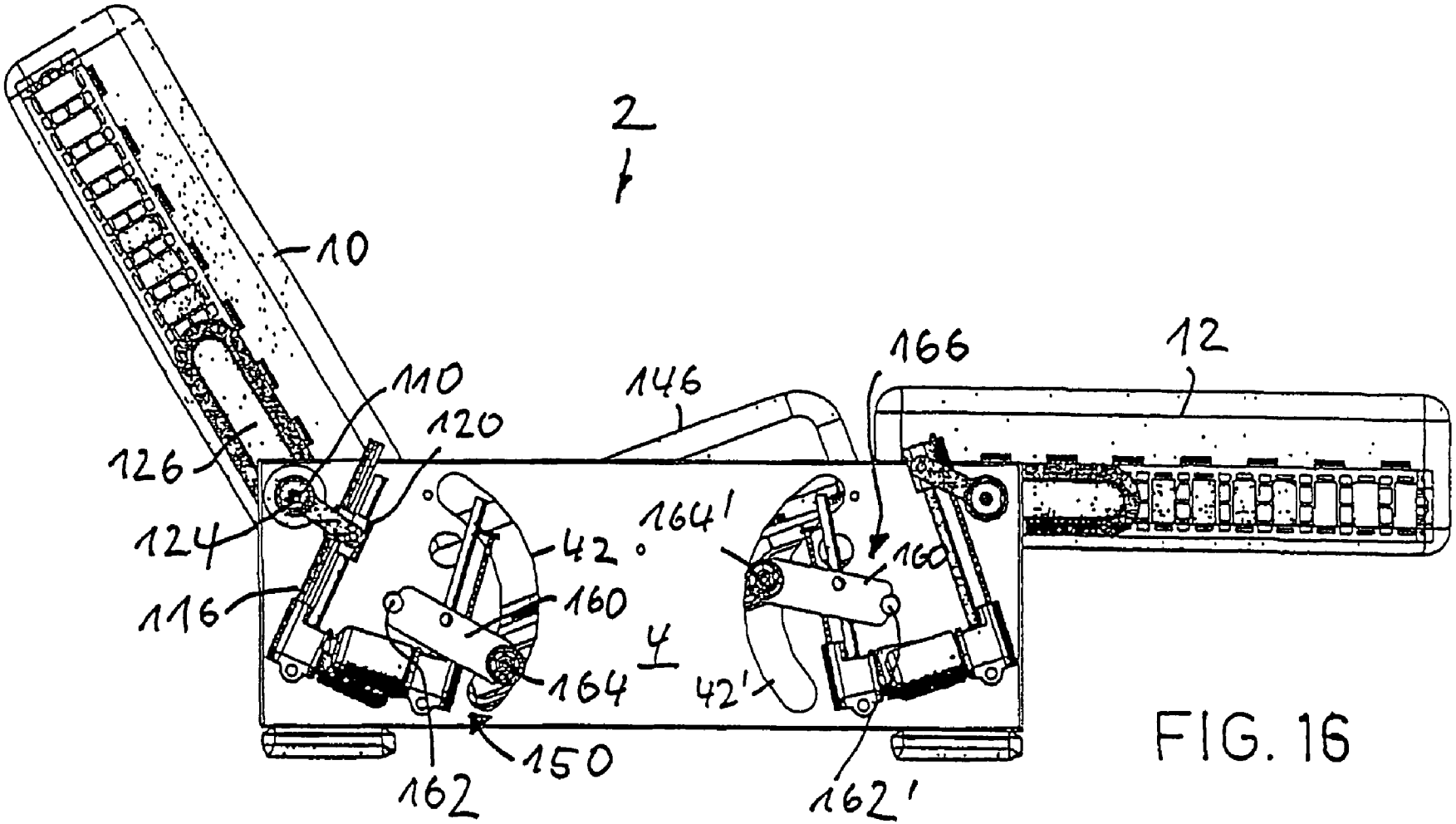
FIG. 16 illustrates the chair as shown in FIG. 12 illustrated as in FIG. 13, yet in smaller scale, wherein only part of the base of the chair is illustrated.
Figure 17:
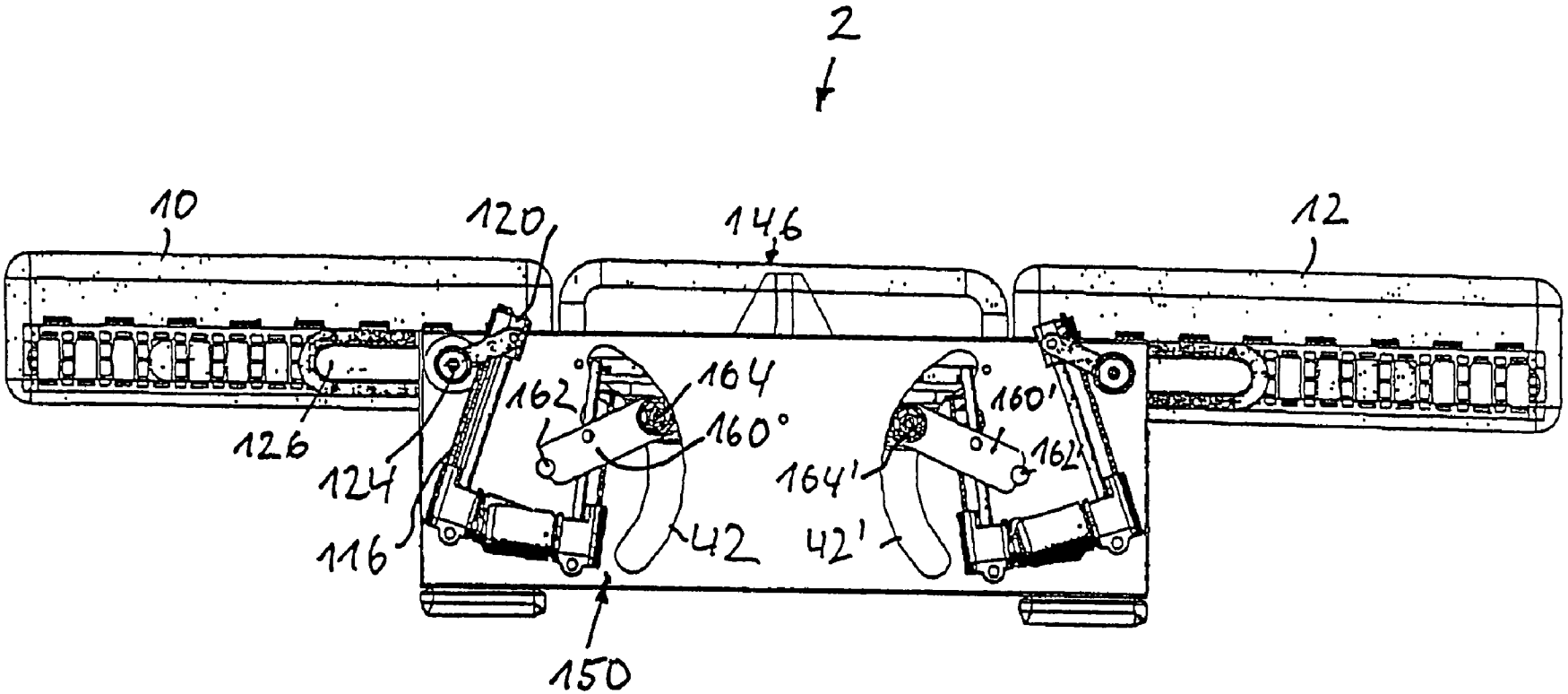
FIG. 17 illustrates a fourth embodiment of the inventive chair illustrated as in FIG. 16.

FIG. 16 shows a fourth embodiment of an inventive chair, which distinguishes itself from the embodiment illustrated in FIG. 12 in that the end of the seat portion 146 facing the armrest 12 is connected to a fourth electric motor adjustment drive 166, which has the same construction as the third electric motor adjustment drive. FIG. 16 shows the chair in a resting position, while FIG. 17 shows the chair in a lying position. By means of the fourth electric motor adjustment drive 166, it is possible to pivot the seat portion 146 both clockwise and counterclockwise about the pivot axis in FIG. 16. In contrast to the embodiment shown in FIG. 12, the seat portion 146 is not fixed to the base. Instead, the pivot axis 164' is connected to a lever 160', which is actuated by the fourth electric motor adjustment drive in the same way lever 160 is actuated by the third electric motor adjustment drive 150. By means of the third electric motor adjustment drive 150 and the fourth electric motor adjustment drive it is possible to adjust both the pitch and the height of the seat portion 146.

As FIGS. 16 and 17 demonstrate, the pivot axis 124 is mounted via a fixed pivot bearing pivotably to the base 2. FIGS. 16 and 17 also show that the pivot axis 164 is formed by the pivot shaft, which runs throughout the entire extent of the seat portion 146 and is mounted on the opposing sections of wall on the base 2. To facilitate the movement of the pivot shaft forming the pivot axis 164, a slit 42 is present, which is formed in the base.

Figure 18:
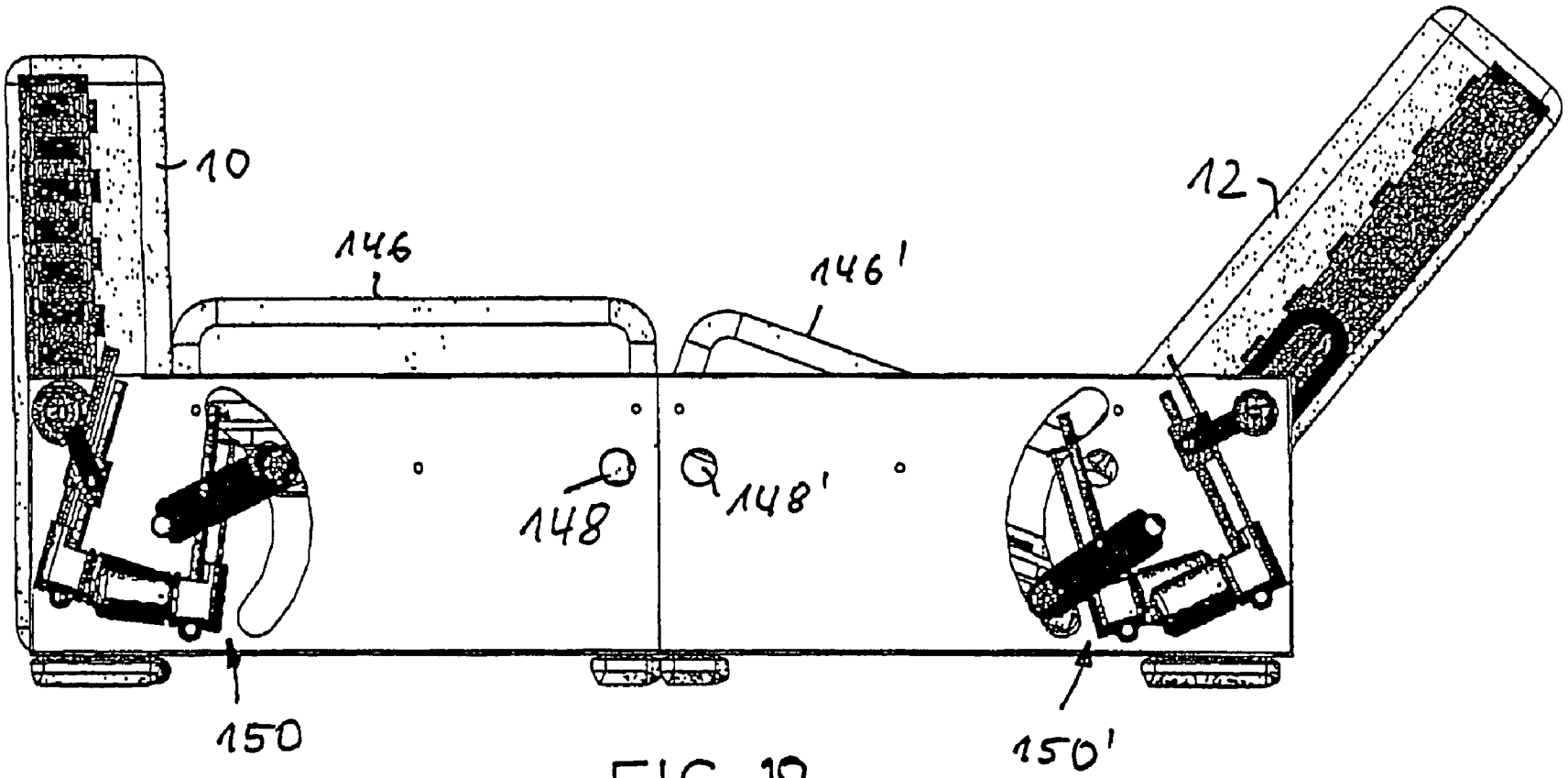
FIG. 18 illustrates a fourth embodiment of the inventive chair illustrated as in FIG. 14.

FIG. 18 illustrates a fifth embodiment of an inventive chair 2, which distinguishes itself from the embodiment illustrated in FIG. 12 in that the seat portion 146 is supplemented by an additional seat portion 146'. In this embodiment the chair 2 forms a loveseat. As FIG. 18 demonstrates, the seat portions 146, 146' are placed side-by-side, whereby the additional seat portion 146' is adjacent the armrest 12. The additional seat portion is connected pivotably about a fourth pivot axis 148' to the base 2, wherein an additional third electric motor adjustment drive 150' is present to facilitate the pivoting of the seat portion 146'. The manner in which the additional seat portion 146' is mounted to the base 2 is identical to the mounting of the seat portion 146 to the base 2 and is therefore not described in further detail. The additional electric motor adjustment drive 150' features the same construction as the electric motor adjustment drive 150 and is therefore not described in further detail.

Figure 19:
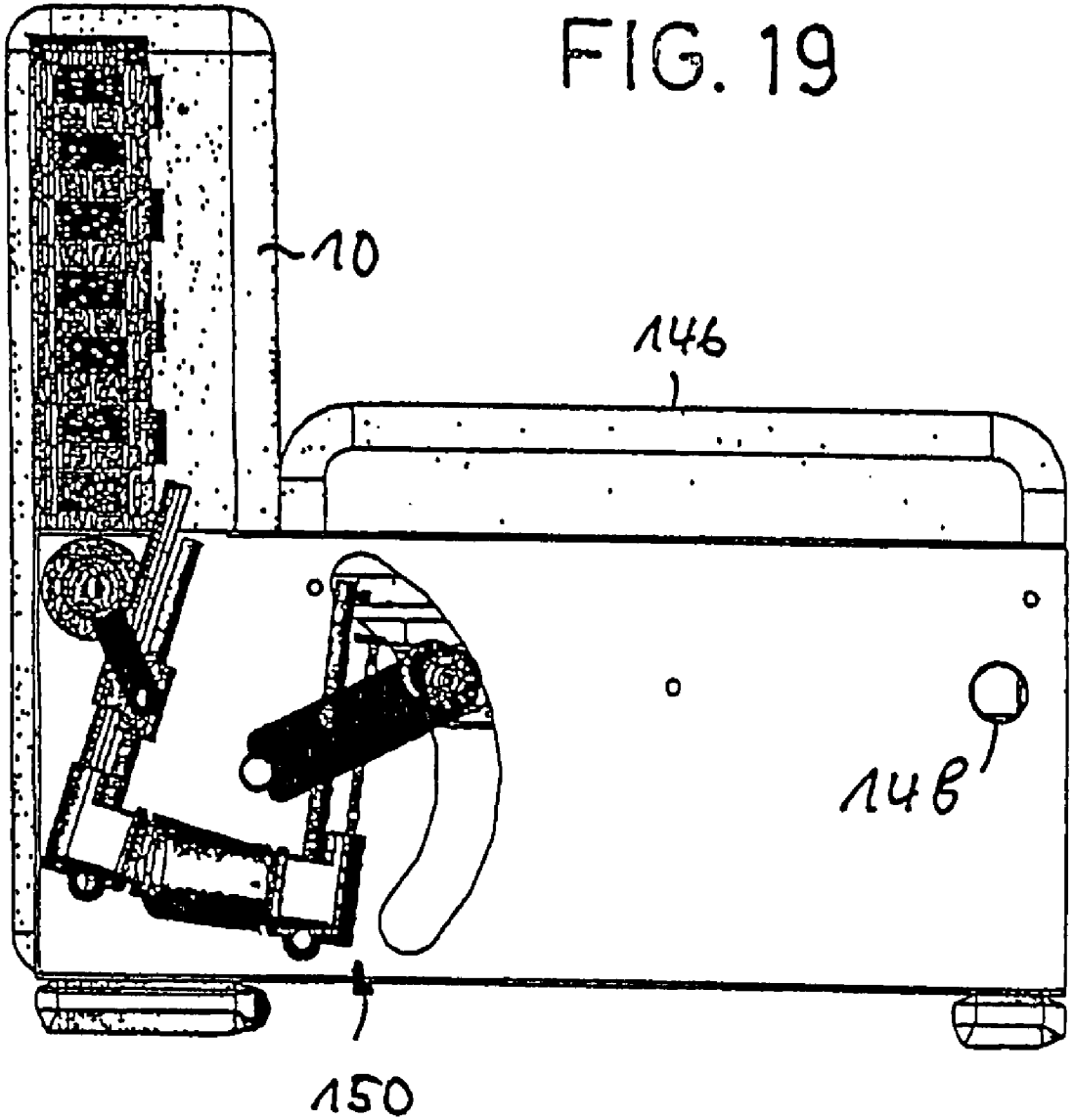
FIG. 19 illustrates a detail of the chair as shown in FIG. 18.
Figure 20:
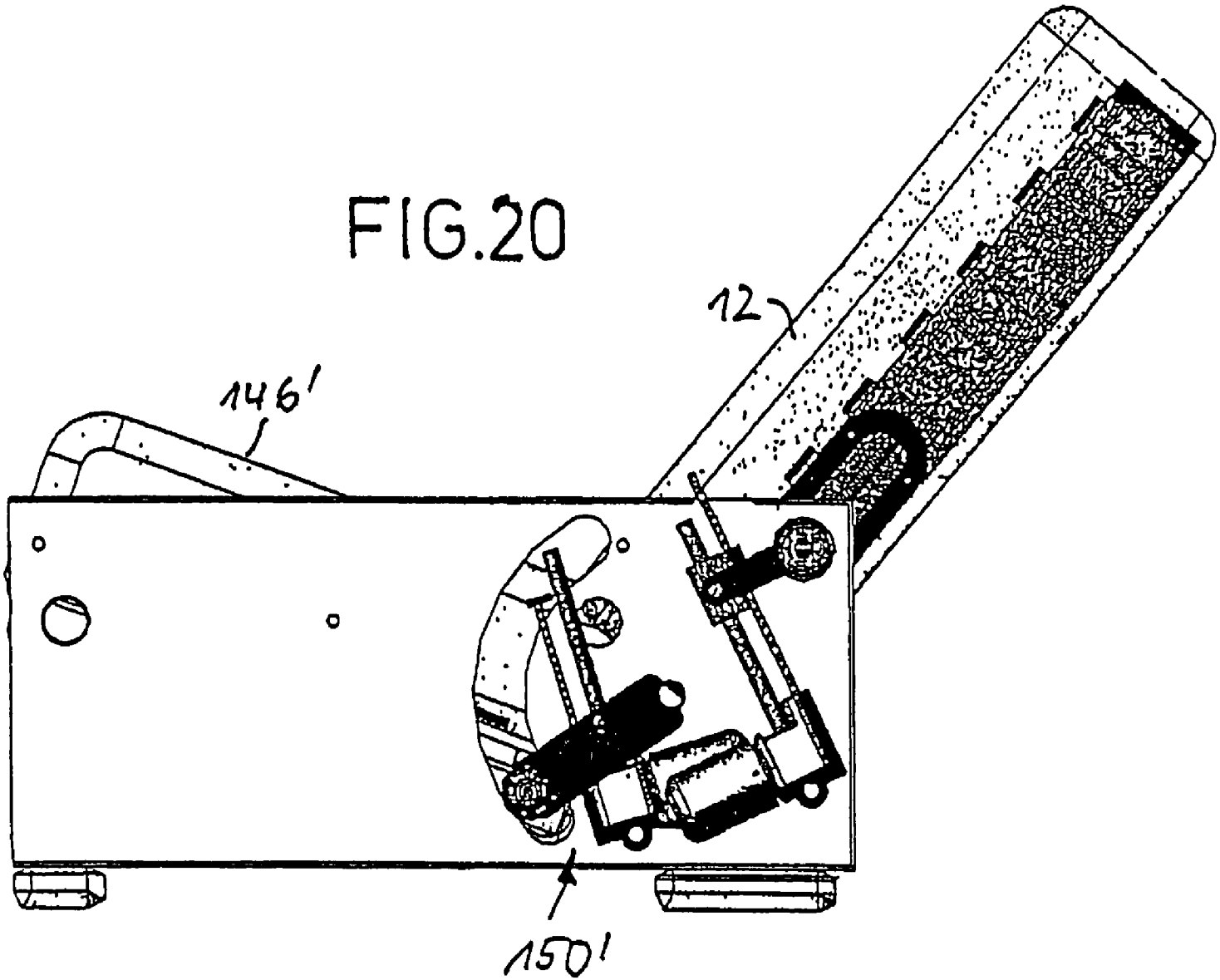
FIG. 20 illustrates a further detail of the chair as shown in FIG. 18.

FIG. 19 is an enlarged view of a detail of an area of the armrest 10 and seat portion 146 of the embodiment illustrated in FIG. 18. FIG. 20 is a detail of an area of the armrest 12 and the additional seat portion 146'.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A chair, comprising:

a) a base body;

b) a sitting surface provided on the base body;

c) a first armrest and a second armrest, the first and second armrests being provided laterally relative to the sitting surface;

d) the first armrest including an upright position, in which a surface of the first armrest is configured for supporting an arm, and a reclined position, in which a further surface of the first armrest is configured for providing at least a portion of a lying surface, the further surface of the first armrest being configured so that in the reclined position at least a portion of a bed is formed;

e) a first pivot axis being provided, the first armrest being pivotable relative to the base body about the first pivot axis for moving between its upright position and its reclined position;

f) an electromotive pivot drive being provided, and the first armrest being connectable to the electromotive pivot drive; and g) the first armrest being mounted on the base body, and being displaceable perpendicularly relative to the first pivot axis.

2. Chair as in claim 1, wherein:

a) a second pivot axis is provided on the base body to facilitate the pivoting of the first armrest, the first armrest being pivotably connected to the second pivot axis by a lever mounted on the base body; and b) an end of the lever facing away from the second pivot axis is pivotably connected about a third pivot axis to the first armrest, and the lever is actuated by the electromotive pivot drive.

3. Chair as in claim 2, wherein:

a) the first armrest is mounted on the base body and is displaceable along an imaginary line running between the first pivot axis and the third pivot axis.

4. Chair as in claim 3, wherein:

a) the sitting surface includes at least one seat portion mounted on the base body, and pivotable about a fourth pivot axis relative to the base body.

5. Chair as in claim 4, wherein:

a) one of the at least one seat portions is connected to the electromotive pivot drive.

6. Chair as in claim 4, wherein:

a) the at least one seat portion includes two seat portions, one of which is connected to a separate pivot drive.

7. Chair as in claims 4, wherein:

a) two seat portions are each connected to a separate pivot drive.

8. Chair as in claim 4, a) the fourth pivot axis runs substantially perpendicularly relative to an imaginary line spanning the distance between the first armrest and second armrests.

9. Chair as in claim 4, wherein:

a) the electromotive pivot drive includes a linear drive, a drive mechanism of which actuates the lever;

b) the drive mechanism includes a spindle nut nonrotatably connected to a rotary-driven threaded spindle and axially moveable on the spindle; and c) the spindle nut is pivotably connected by a fifth pivot axis to the lever, and the threaded spindle is connected pivotably about a sixth pivot axis relative to the base body.

10. Chair as claimed in claim 4, wherein:

a) the electromotive pivot drive includes a linear drive, a drive mechanism of which actuates the lever; and b) the drive mechanism includes an axially movable threaded spindle which is secured against rotation, and a rotary-driven spindle nut threaded on the spindle, the threaded spindle is pivotably attached to a fifth pivot axis on the lever, and the spindle nut is pivotably connected to the base body by a sixth pivot axis.

11. Chair as in claim 10, wherein:

a) one of the second pivot axis, the third pivot axis, the fourth pivot axis, the fifth pivot axis, and the sixth pivot axis is substantially parallel to the first pivot axis.

12. Chair as in claim 10, wherein:

a) two of the second pivot axis, the third pivot axis, the fourth pivot axis, the fifth pivot axis, and the sixth pivot axis are parallel to one another.

13. Chair as in claim 10, wherein:

a) at least one of the first pivot axis, the second pivot axis, the third pivot axis, the fourth pivot axis, the fifth pivot axis, and the sixth pivot axis is a substantially horizontal pivot axis.

14. Chair as claim 2, wherein:

a) the electromotive pivot drive includes a linear drive, a drive mechanism of which actuates the lever.

15. Seat as in claim 2, wherein:

a) the base body includes a stationary tube, which defines the third pivot axis, and which engages a track provided in the first armrest.

16. Chair as in claim 1, wherein:

a) the first armrest and the second armrest each includes a reclined position in which the first armrest and the second armrest form together with the sitting surface a lying surface.

17. Chair as in claim 16, wherein:

a) the second armrest includes an upright position, in which a surface of the second armrest is configured for supporting an arm; and b) the first armrest and the second armrest are adjustable directly between their upright and their reclined positions.

18. Chair as in claim 16, wherein:

a) the lying surface formed by the first and second armrests is a substantially level surface when the first and second armrests are in reclined position.

19. Chair as in claim 1, wherein:

a) the first and second armrests include a block-like construction.

20. Chair as in claim 1, wherein:

a) the first and second armrests include one of cushioned surfaces and surfaces supported by a suspension defining the portion of a lying surface when in the reclined position.

21. Chair as in claim 20, wherein:

a) the suspension includes elastic slats.

22. Chair as in claim 20, wherein:

a) the suspension includes a slatted frame.

23. Chair as in claim 1, wherein:

a) the first armrest includes a support rest, the support rest facing away from the sitting surface, and being adjustable relative to the first armrest.

24. Chair as in claim 23, wherein:

a) the support rest is pivotable relative to the first armrest.

25. Chair as in claim 1, wherein:

a) the second armrest including an upright position, in which a surface of the second armrest is configured for supporting an arm, to a reclined position, in which a further surface of the second armrest is configured for providing at least a portion of a lying surface, the further surface of the second armrest being configured so that in the reclined position at least a portion of a bed is formed; and b) each of the first and second armrests is connected to a separate adjustment mechanism for facilitating the adjustment of the respective armrests between their upright and reclined positions.

26. Chair as in claim 25, wherein:

a) the separate adjustment mechanisms are activated independently of one another.

27. Chair as in claim 25, wherein:

a) facing portions of the first and second armrests face one another when in their respective upright positions, the facing portions defining the portion of a lying surface when the first and second armrests are in their reclined positions.

28. Chair as in claim 27, wherein:

a) the facing portions of the first and second armrests defining the portion of the lying surface when in their reclined positions are folded down by approximately 90° from their upright positions.

29. Chair as in claim 1, wherein:

a) the first and second armrests are pivoted and shifted perpendicularly relative to the first pivot axis by a common electromotive adjustment drive.

30. Chair as in claim 1, wherein:

a) a first electromotive pivot drive being provided to facilitate the pivoting of the first armrest; and b) a further electromotive pivot drive being provided to facilitate the perpendicular displacement of the first armrest relative to the first pivot axis.

* * * * *